US006170792B1

(12) United States Patent
Miceli et al.

(10) Patent No.: US 6,170,792 B1
(45) Date of Patent: Jan. 9, 2001

(54) CUSTOMIZABLE, TRANSPORTABLE, MODULAR PRESENTATION SYSTEM

(75) Inventors: Charles Miceli; Edward T. Ebert, both of Southington, CT (US)

(73) Assignee: Triple-P, LLC, Southington, CT (US)

( * ) Notice: Under 35 U.S.C. 154(b), the term of this patent shall be extended for 0 days.

(21) Appl. No.: 09/358,097

(22) Filed: Jul. 21, 1999

Related U.S. Application Data

(60) Provisional application No. 60/093,517, filed on Jul. 21, 1998.

(51) Int. Cl.[7] ..... A47B 23/00
(52) U.S. Cl. ..... 248/441.1; 248/457
(58) Field of Search ..... 248/441.1, 447, 248/446.1, 454, 455, 457; 40/776, 771

(56) References Cited

U.S. PATENT DOCUMENTS

| | | | | |
|---|---|---|---|---|
| 2,191,755 | | 2/1940 | Dearing . | |
| 2,549,306 | | 4/1951 | Greene . | |
| 2,681,030 | | 6/1954 | Hoge . | |
| 5,083,737 | | 1/1992 | Rifkin | 248/454 |
| 5,172,883 | * | 12/1992 | Amirian | 248/441.1 |
| 5,245,775 | * | 9/1993 | Goserud | 40/776 |
| 5,624,097 | | 4/1997 | Potter | 248/464 |
| 5,720,464 | | 2/1998 | Meinscher et al. | 248/447 |
| 5,725,192 | * | 3/1998 | Cloninger | 248/458 |
| 5,898,962 | * | 5/1999 | McNeal | 40/776 X |

OTHER PUBLICATIONS

Stanrite Catalog, Visual Communicator Easels, (date unknown), p. 117.
Board Easels Catalog, 1997 Copyright, p. 44.

* cited by examiner

*Primary Examiner*—Ramon O. Ramirez
(74) *Attorney, Agent, or Firm*—William C. Crutcher

(57) ABSTRACT

The present invention is directed to a presentation easel which serves as a foundation for a robust, modular, presentation system. In addition, the presentation easel is highly customizable to a wide variety of customer needs and desires. In an exemplary embodiment, the presentation easel comprises a rectangular frame including first and second horizontal support members and first and second vertical support members, which are all preferably formed of rectangular metal tubes. A fabric shell is provided around the frame and includes an openable side to permit access to a cavity formed between the fabric shell. The cavity is intended to provide a convenient and easy storage area where presentation materials, including relatively large presentation writing pads, may be stored. One surface of the fabric shell is used as a presentation surface to locate and place presentation material and the like. The presentation easel also includes adjustable legs and a pair of wheels to permit easy transportation of the presentation easel.

22 Claims, 24 Drawing Sheets

CUSTOMIZABLE, TRANSPORTABLE, MODULAR PRESENTATION SYSTEM

CROSS-REFERENCE TO RELATED APPLICATIONS

This application claims the benefit of U.S. Provisional Applications Ser. No. 60/093,517 filed Jul. 21, 1998.

BACKGROUND OF THE INVENTION

1. Field of the Invention

The present invention relates to presentation systems and more particularly to a transportable presentation easel that provides the foundation for a modular, fully customizable presentation system which is light-weight, durable, and attractive.

2. Brief Description of the Related Art

There are many types of presentation easels currently on the market. The simplest are tripod leg stands between five and six feet tall. The legs may be retractable, telescoping or fixed. The rear leg extends backward to form an inclined surface along the front legs. Sometimes the easels are equipped with pegs or a shelf about halfway down the front two legs. Display items rest on the pegs or shelf and against the legs. Alternatively, the top of the legs contain a pin or attachable bar which holds the display items suspended and resting on the upper portion of the legs. Alternatively, the presentation easel contains a rectangular metal, plastic or fiber backing board surface mounted on tripod or quad leg supports. The legs are generally retractable so that the height of the presentation easel is adjustable. The front of the easel is normally equipped with a bar of pins for hanging a flip chart pad. Fixed or attachable shelves or a storage compartment located at the front bottom of the backing board holds markers, erasers and other accessories or the like. Some models contain one or more fixed compartments mounted on the rear of the backing board for storage of additional accessories.

With the legs extended, most presentation easels sit on the floor for comfortable viewing by a standing individual or a seated audience. Alternatively, with the legs retracted, most can be set atop a table for viewing. One prior art product is directed to a combination easel and carrying case employing a two part, hard covered case which is folded in half for setting up and storage and which contains several compartments for storage of accessories.

Many presentation easels contain a number of similarities and limitations. Other than availability of some models in a very limited number of colors, none of the products currently available offer any significant amount of customizing capability. Customers must accept the fixed configurations offered by the manufacturer. Artist easels tend to be flimsy and poorly suited for flip cart presentations. The metal, fiberboard or hard plastic construction of flip chart products tends to make these products bulky and heavy. Conventional presentation easels are also not designed to provide an aesthetically pleasing indicia display area, e.g., marketing and advertising platform, when not in active use. To meet audio-visual needs such as for a screen or podium, the customer must purchase additional, separate products and use additional floor space for storing and using them. Currently available products, many of which weigh 20 pounds or more, must be hand carried. Accordingly, a severe limitation of the prior art presentation easels is that the products do not provide for transportation of additional audio-visual equipment. The existing presentation easels do not provide for storage of additional, unaltered, flip chart pads, full size artwork or other full size display items. Furthermore, these products are not equipped to integrate electrical or electronic components for advanced uses, such as lighted display board usage or computer up-load capabilities.

Thus, there is a perceived need for a transportable presentation easel that provides the foundation for a modular, fully customizable presentation system designed to accommodate a large assortment of field mountable, modular accessories. These accessories permit the presentation easel to serve a wide array of functions beyond the more basic display function found in conventional presentation easels.

SUMMARY OF THE INVENTION

The present invention is directed to a presentation easel which serves as a foundation for a robust, modular, presentation system. In addition, the presentation easel is highly customizable to a wide variety of customer needs and desires. In an exemplary embodiment, the presentation easel comprises a rectangular frame including first and second horizontal support members and first and second vertical support members, which are all preferably formed of rectangular metal tubes. A fabric shell is provided around the frame and includes an openable side to permit access to a cavity formed between the fabric shell. The cavity is intended to provide a convenient and easy storage area where presentation materials, including relatively large presentation writing pads, may be stored. One surface of the fabric shell is used as a presentation surface to locate and place presentation material and the like.

The presentation easel also includes adjustable legs and in the exemplary embodiment, the adjustable legs include front legs which are adjustably received within first and second vertical support members. In addition, a rear leg assembly is provided, wherein first and second rear leg members are adjustably (i.e. hingedly) attached to the rear surface of the first and second vertical support members. A pair of adjustable rear legs are adjustably received within first and second rear leg members. In this embodiment, the presentation easel comprises a four legged structure. In one embodiment, the adjustable front and rear legs are locked into place at predetermined locations of the first and second vertical support members and the first and second rear leg members by a spring loaded pin assembly which penetrates a side bore to lock the respective leg in place.

In one aspect, the presentation easel includes a plurality of storage compartments provided on a rear surface of the fabric shell. In an exemplary embodiment, the plurality of storage compartments comprises a plurality of pouches which are sewn into the fabric shell and include zippered openings. These storage compartments permit the presentation easel to store a variety of items, including markers, erasers, tent-cards, handouts, etc., either during use of the presentation easel or during transportation thereof.

A pair of wheels are preferably provided on a cross support member extending between the first and second vertical support members. These wheels are slightly raised in relation to feet which are formed at ends of the first and second adjustable front legs so that the wheels engage the ground by slightly tilting the presentation easel resulting in an easily transportable presentation system. A wide variety of accessories may be used with the presentation easel that convert the presentation easel into a portable podium, a portable lighted display board, or a portable audio-visual screen. Yet another feature of the presentation easel of the present invention is that it can be used as a hand truck for the transportation of audio-visual equipment and supplies.

A fold down shelf is also provided between the first and second vertical support members and the first and second rear leg members. This fold down shelf includes an additional storage in a cavity formed between a fabric shell disposed around the frame of the shelf and the shelf includes a support surface so that equipment and the like can be stored during the use of presentation easel or transportation thereof.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
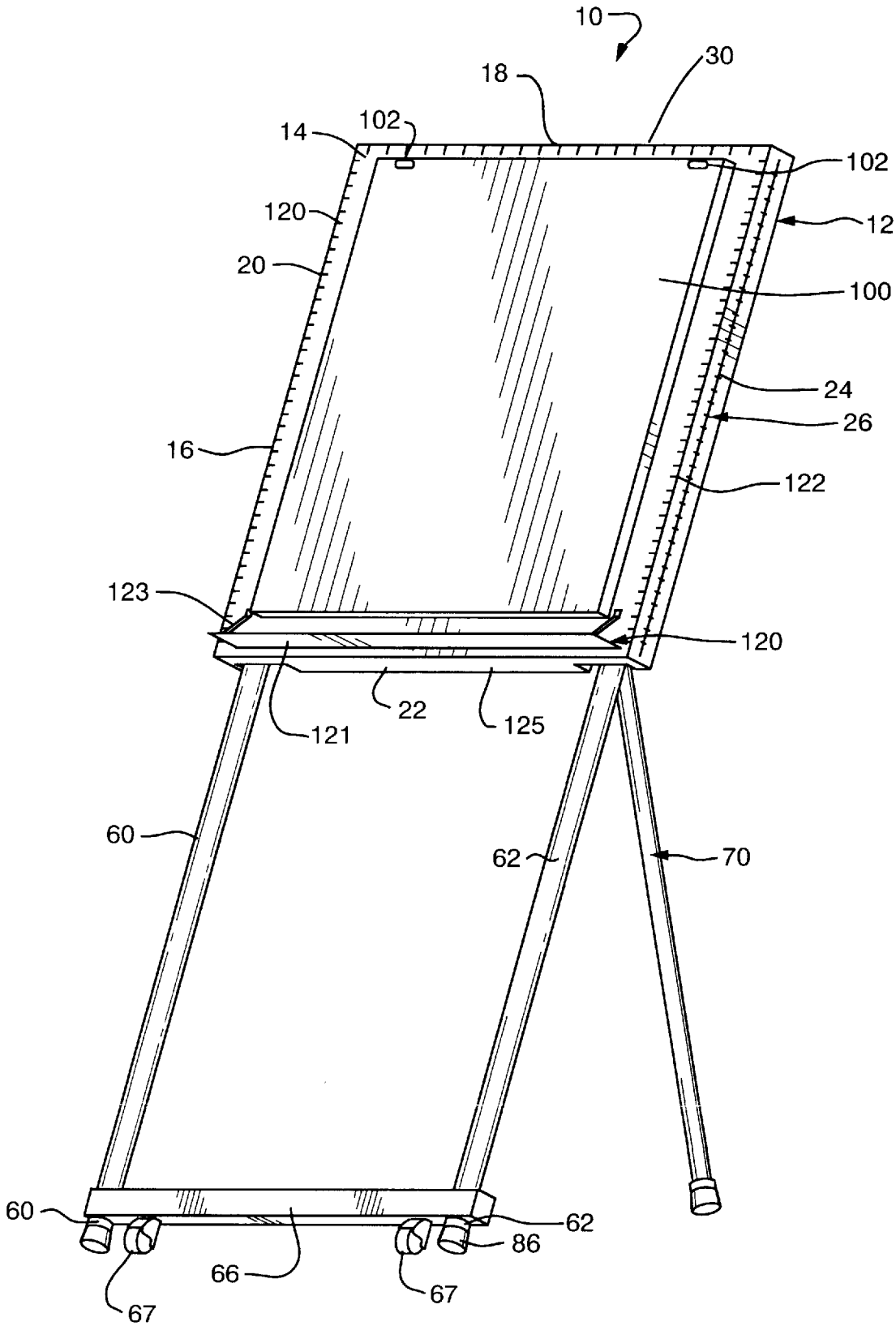
FIG. 1 is front perspective view of a first embodiment of a presentation easel of the present invention.
Figure 2:
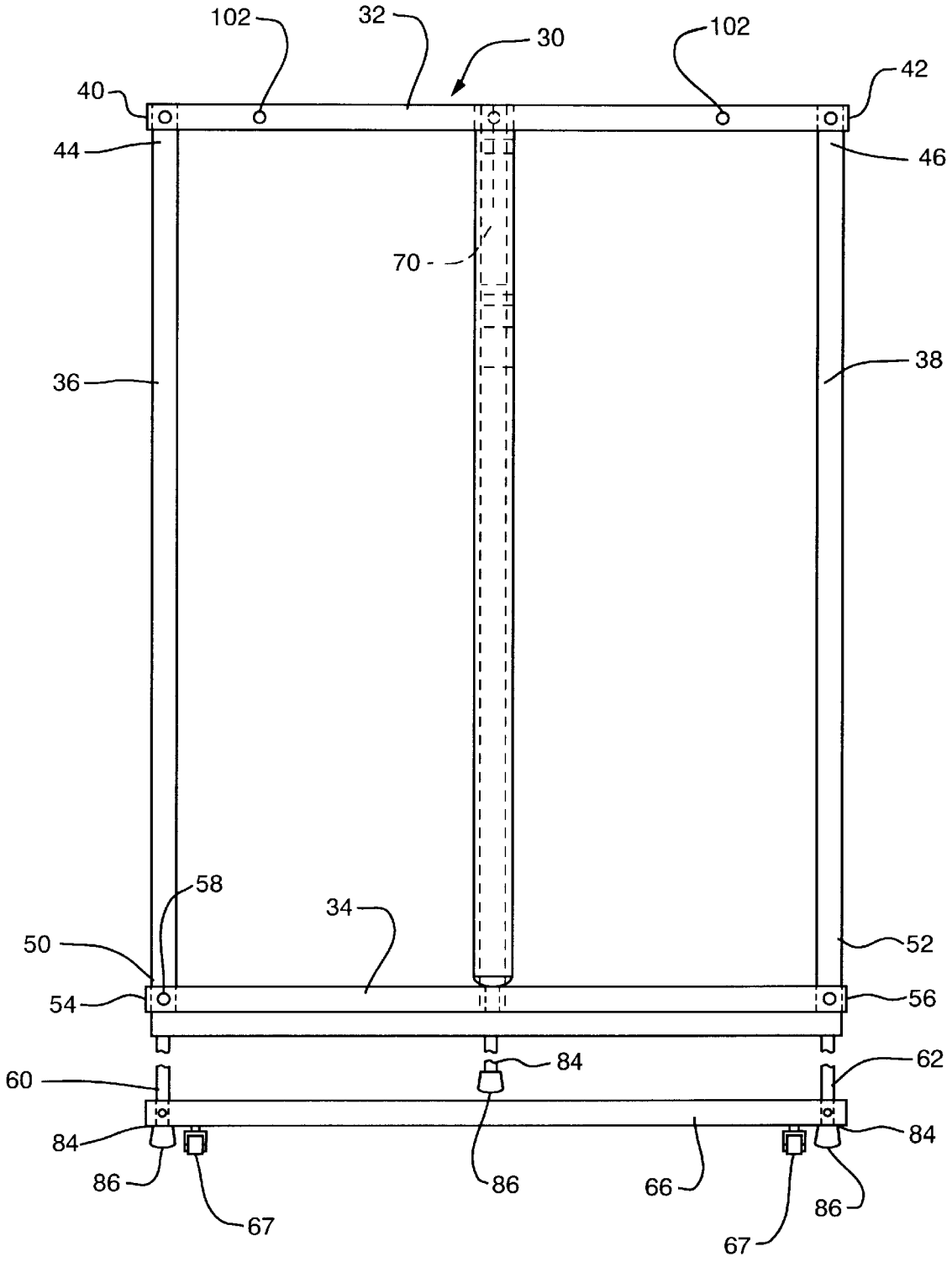
FIG. 2 is a partially fragmented front elevation view of the presentation easel of FIG. 1 showing a frame thereof.

Turning to FIGS. 1–2. FIG. 1 is a front perspective view of a presentation easel of a first embodiment and is generally indicated at 10. Presentation easel 10 comprises a highly customizable easel that serves as the foundation for a complete, modular presentation system. Easel 10 includes a main body 12 which includes a main viewing and support surface 14. Preferably, main body 12 comprises fabric body sewn in the form of a rectangular box that forms an soft, outer, single piece shell 16. Shell 16 is closed on three sides 18, 20, 22 and has a fourth side 24 which may be opened using a suitable device such as a zipper 26. In other words, in the exemplary and illustrated embodiment, zipper 26 is employed in fourth side 24 so that material forming fourth side 24 may be at least partially opened to permit access to an internal cavity (not shown in FIG. 1) formed within shell 16.

Body 12 has a frame generally indicated at 30, wherein frame 30 supports shell 16 and shapes shell 16 so that body 12 is in the form of a rectangular box. As best shown in FIG. 2, frame 30 includes a first horizontal support member 32 which preferably comprises an elongated rectangular tube. In one exemplary embodiment, first horizontal support member 32 comprises a 1"×2" aluminum rectangular tube. It is understood that any other suitable material may be used in the above-mentioned dimensions and shape are recited only for the purpose of illustration. In the illustrated embodiment, first horizontal support member 32 comprises a top portion of the body 12. An opposing second horizontal support member 34 comprises a bottom portion of the body 12 and preferably is identical to first horizontal support member 32, namely an elongated rectangular tube. Body 12 also includes first and second vertical support members 36, 38 which run vertically along the outside of shell 16 and serves as fixed leg outer housings. First and second vertical support members 36, 38 intersect and are connected to first horizontal support member 32 at first and second ends 40, 42 of first horizontal support member 32. More specifically, first and second ends 40, 42 of first horizontal support member 32 are connected, through the shell fabric 16, to upper ends 44, 46 of first and second vertical support members 36, 38, respectively.

Likewise, bottom end portions 50, 52 of first and second vertical support members 36, 38, respectively, are attached to first and second ends 54, 56 of second horizontal support member 34 through shell fabric 16. Any suitable number of fastening devices 58, such as bolts and "T" connectors, may be used to attach first and second vertical support members 36, 38 to first and second horizontal support members 32, 34. A pair of lower leg extensions 60, 62 are received within the opening defined by first and second vertical support members 36, 38 so that lower leg extension 60 is received within first vertical support member 36 and lower leg extension 62 is received within second vertical support member 38. Lower leg extensions 60, 62 may be mechanically locked in place at any number of points within first and second vertical support members 36, 38 (upper leg extensions) to form retractable leg assemblies. In a preferred embodiment, lower leg extensions 60, 62 are either formed from a single U-shaped member, e.g, tubular member, or lower leg extensions 60, 62 are mechanically attached with a cross support member 66 along the bottom of presentation easel 10. Cross support member 66 includes a pair of wheels (casters) 67 attached thereto. Wheels 67 are raised slightly in relation to bottommost portions of legs extensions 60, 62 so that presentation easel 10 is moveable by engaging wheels 67 by tilting presentation easel 10.

Presentation easel 10 also includes a single retractable leg assembly 70 of similar design to lower leg extensions 60, 62 which is hinged to first horizontal support member 32 of easel body 12. Accordingly, single retractable leg assembly 70 comprises a round or rectangular tube. Preferably, single retractable leg assembly 70 and extends away from first horizontal support member 32 at a predetermined angle when presentation easel 10 is in use. Single retractable leg assembly 70 is fixed in place using a sliding bar 80 and fabric straps 110 (center belt) which in combination with each other form a rigid tri-pod assembly. Bottom ends 84 of lower leg extensions 60, 62 and single retractable leg assembly 70 preferably include feet 86 which in an exemplary embodiment comprise rubber boots.

Referring now to FIGS. 1–12. During assembly the fabric shell 16 is stretched tight by the fastening of first and second horizontal support members 32, 34 and first and second vertical support members 36, 38 to one another, creating a flat, taught exterior front surface 14 and rear surface 88 with an interior cavity being formed therebetween. The interior cavity is larger in size than a standard size flip chart pad, allowing large optional accessories or a box of additional flip chart pads to be stored therein. When full size items are stored inside the interior cavity, a firmer backing surface is created for a working pad 100 which is disposed on front surface 14 and further increases the dimensional stability of presentation easel 10. Since the internal cavity is filly enclosed by fabric shell 16, the items inside within the internal cavity are protected and are securely housed and need not be altered for mounting on pins or rings in order to be transported. Thus, the internal cavity comprises a convenient storage area while at the same time it does not alter the functionality of presentation easel 10 as a presentation system.

In the exemplary embodiment, a pair of pins 102 protrude from the top of frame 30 proximate first horizontal support member 32. Pins 102 serve to mount a standard flip chart 100 or the like. In addition, pins 102 may also serve to mount other modular accessories. Presentation easel 10 further includes a center belt 110 which is attached to single retractable leg assembly 70 and extends around to front surface 14 of fabric shell 16 through a pair of side mounted loops 112 which are disposed opposing sides 20, 24 of fabric shell 16. Center belt 110 is fastened in the front at front surface 14. A buckle assembly (not shown) may be used to secure ends of center belt 110 at front surface 14. Preferably center belt 110 is formed of a suitable fabric, e.g., nylon.

Center belt 110 performs two basic functions. When presentation easel 10 is opened for use, center belt 110 is unbuckled in the front. The free ends of center belt 110 are caught in side mounted loops 112 as single retractable leg assembly 70 is pulled in a direction away from body 12. Center belt 110 works in conjunction with a sliding tension bar 111 on the rear of presentation easel 10 to act as a brace, locking single retractable leg assembly 70 firmly in the open position and steadying presentation easel 10. When presentation easel 10 is closed for storage or transportation, center belt 110 buckles in the front at front surface 14 to thereby lock single retractable leg assembly 70 firmly in the closed position while holding the working pad 100 firmly in place for room to room transportation.

A fabric hinged and covered accessory shelf 120 at the bottom front of easel body 12 holds markers and other accessories (not shown). Accessory shelf 120 also serves as a tray for supporting display pieces that are not equipped with mounting holes. Accessory shelf 120 includes a rigid horizontal body 121 having a fabric shell disposed therearound and a pair of hinged straps 123. Preferably, the fabric shell includes a hook and loop fastener on a bottom surface 125. Body 12 of presentation easel 10 is outfitted with a predetermined number of fastening devices, such as zippers, snaps, and the like which hold optional accessories firmly in place. In a preferred embodiment, a first zipper 120 or similar fastening device extends from the center top of the fabric body 12 down to a left side and around to a bottom center of fabric body 12 (best shown in FIG. 1). In a like manner, a matching second zipper 122 or other fastening device extends from the top center of body 12 down to the right side and around to the bottom center so that first and second zippers 120, 122 extend around the entire perimeter of body 12. This arrangement allows installation of a first attachment 130. First attachment 130 which comprises a detachable fabric piece which serves at least the following functions. First, first attachment 130 provides an indicia display surface 132 and thus can act as a marketing medium. Second, first attachment 130 acts as a protective cover. When presentation easel 10 is not actively in use, first attachment 130 provides a highly customizable advertising and marketing medium. The perimeter of first attachment 130 is preferably lined with two reversible zippers 133 that mate with complementary fasteners 122 on fabric body 12 of presentation easel 10. This fastening arrangement allows first attachment 130 to completely enclose the front of presentation easel 10, be hinged along the top for interim use on an as-needed basis or be completely removed or replaced with another first attachment 130 having a different display thereon.

First attachment 130 can be supplied one or two-sided. First attachment 130 can be ordered in a color that matches fabric body 12 of presentation easel 10, or in a variety of optional colors. In addition, a reverse side (not shown) of first attachment 130 can be supplied in the same or a different color. First attachment 130 can further be customized with a customer's name, logo, graphic, slogan, etc. printed on one side 132 only or the same or a different message can appear on the other side (reverse side).

When presentation easel 10 is prepared for transporting, first attachment 130 is zippered close, securing fabric hinged accessory tray 120 in place, protecting working pad 100 and continuing to act as an advertising and marketing medium during transit. Because first attachments 130 are fully detachable, several first attachments 130 can be ordered in different colors, logos, configurations to meet unique advertising and marketing goals and strategies.

Figure 3:
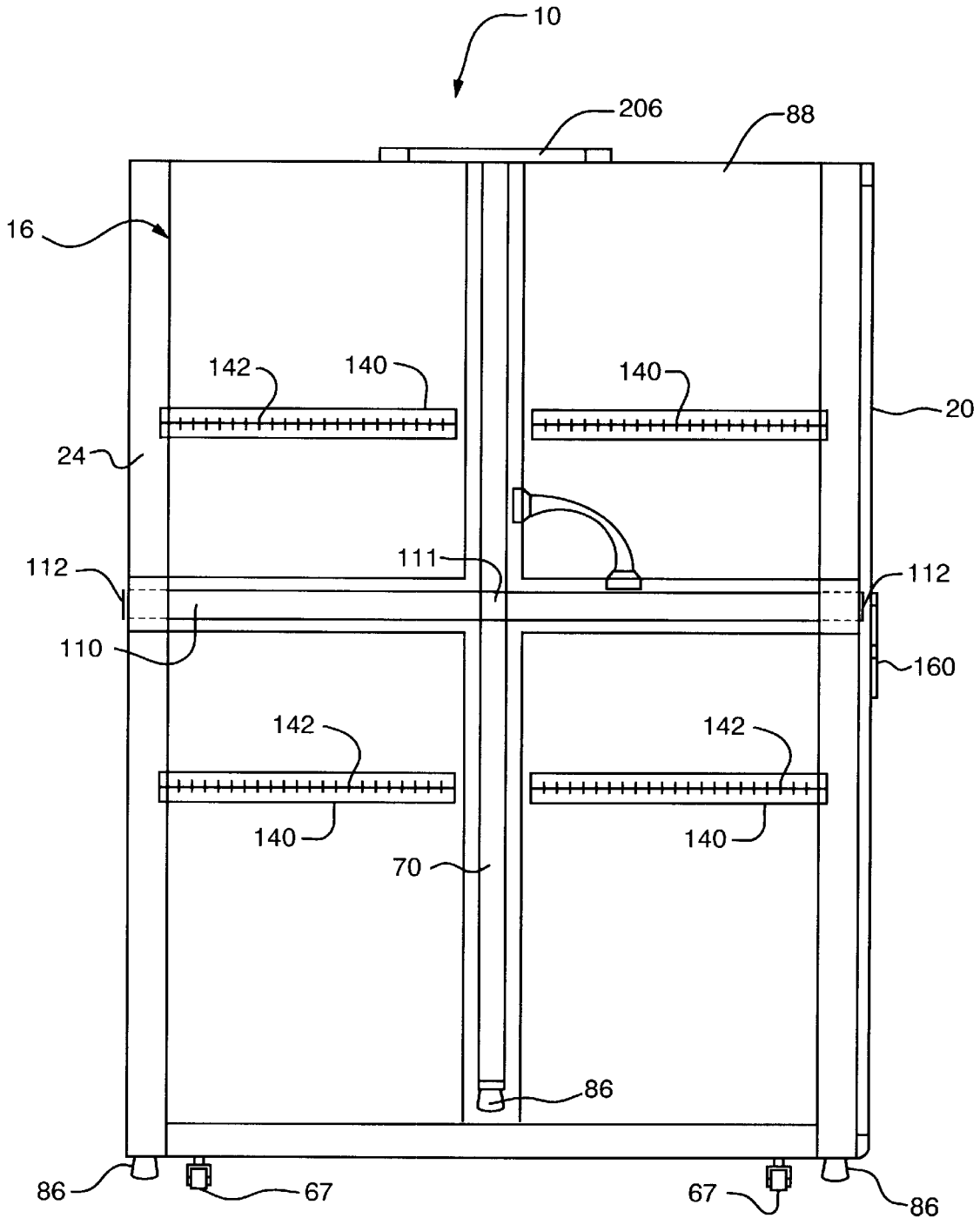
FIG. 3 is a rear view of the presentation easel of FIG. 1.
Figure 4:
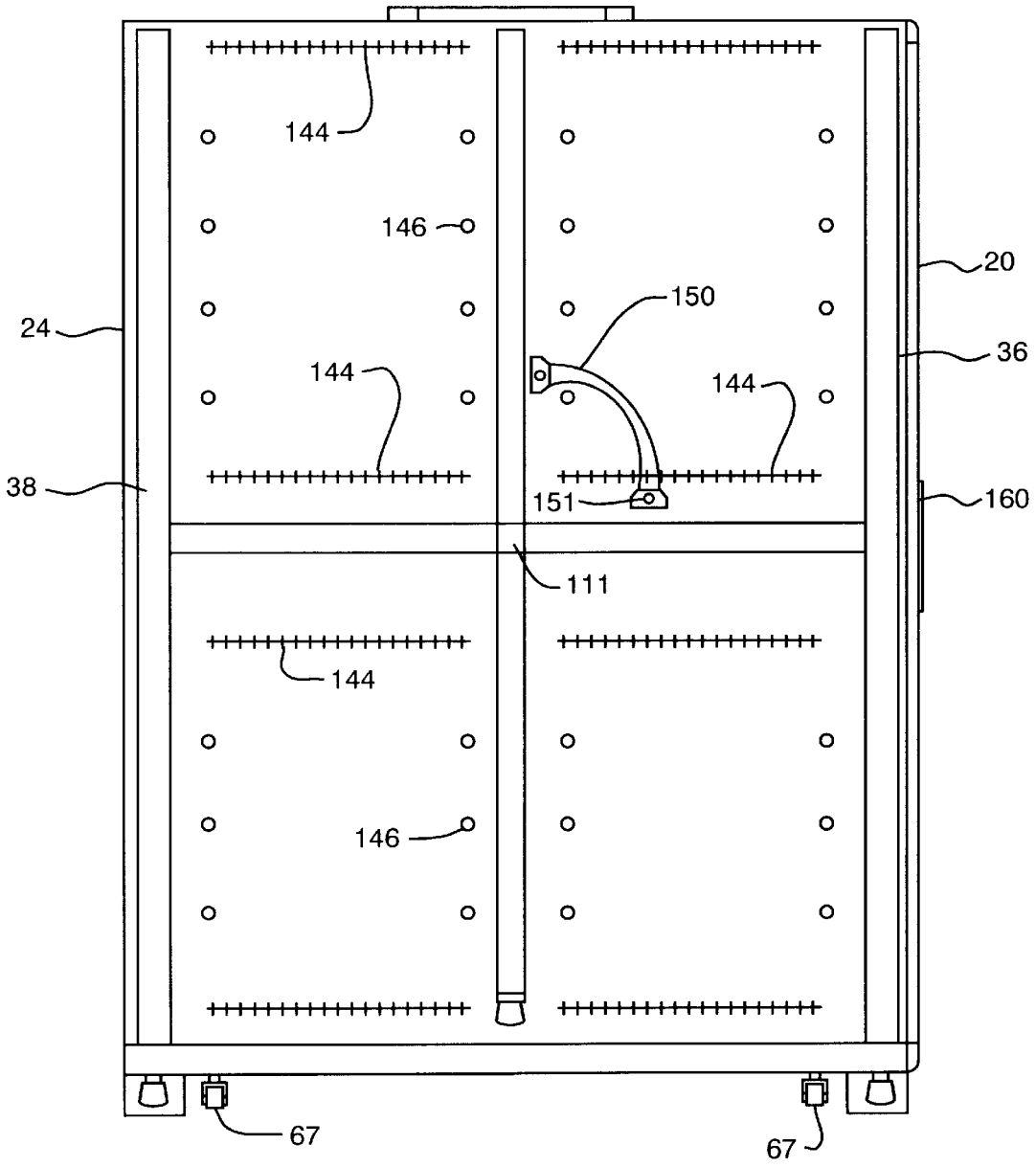
FIG. 4 is a rear view of the presentation easel of FIG. 1 showing optional features.
Figure 5:
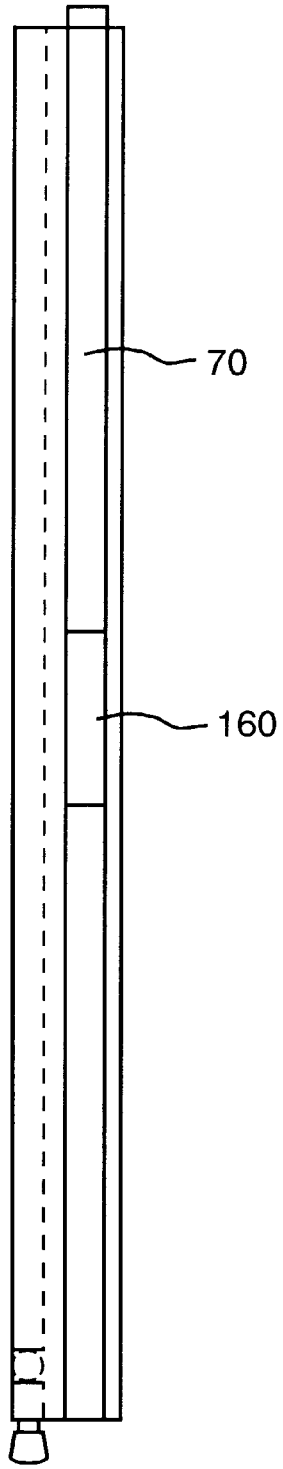
FIG. 5 is a left side view of the presentation easel of FIG. 1 showing easel legs in a retracted position.
Figure 6:
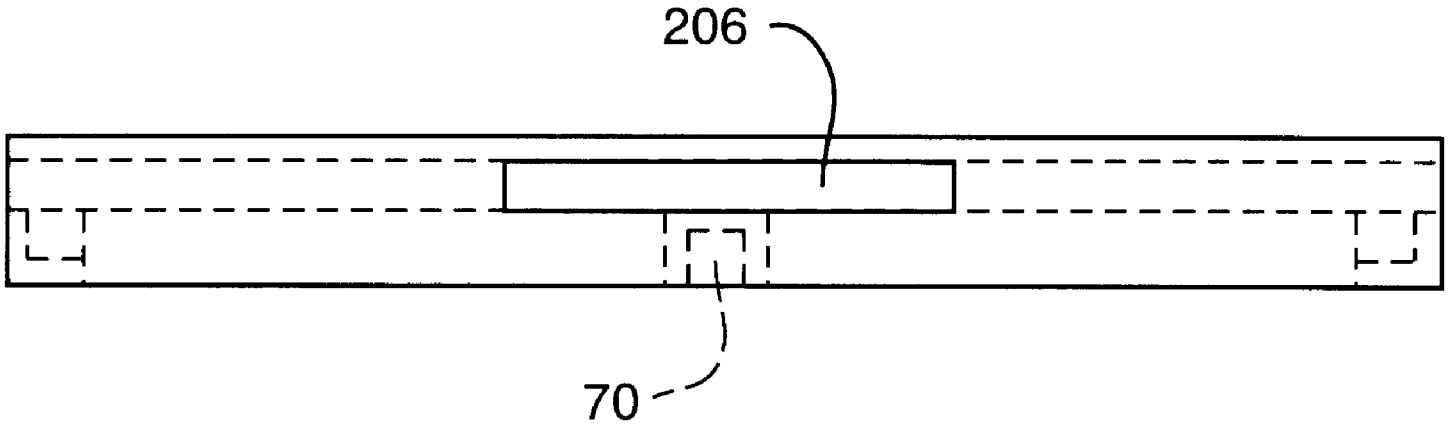
FIG. 6 is a top plan view of the presentation easel of FIG. 1.
Figure 7:
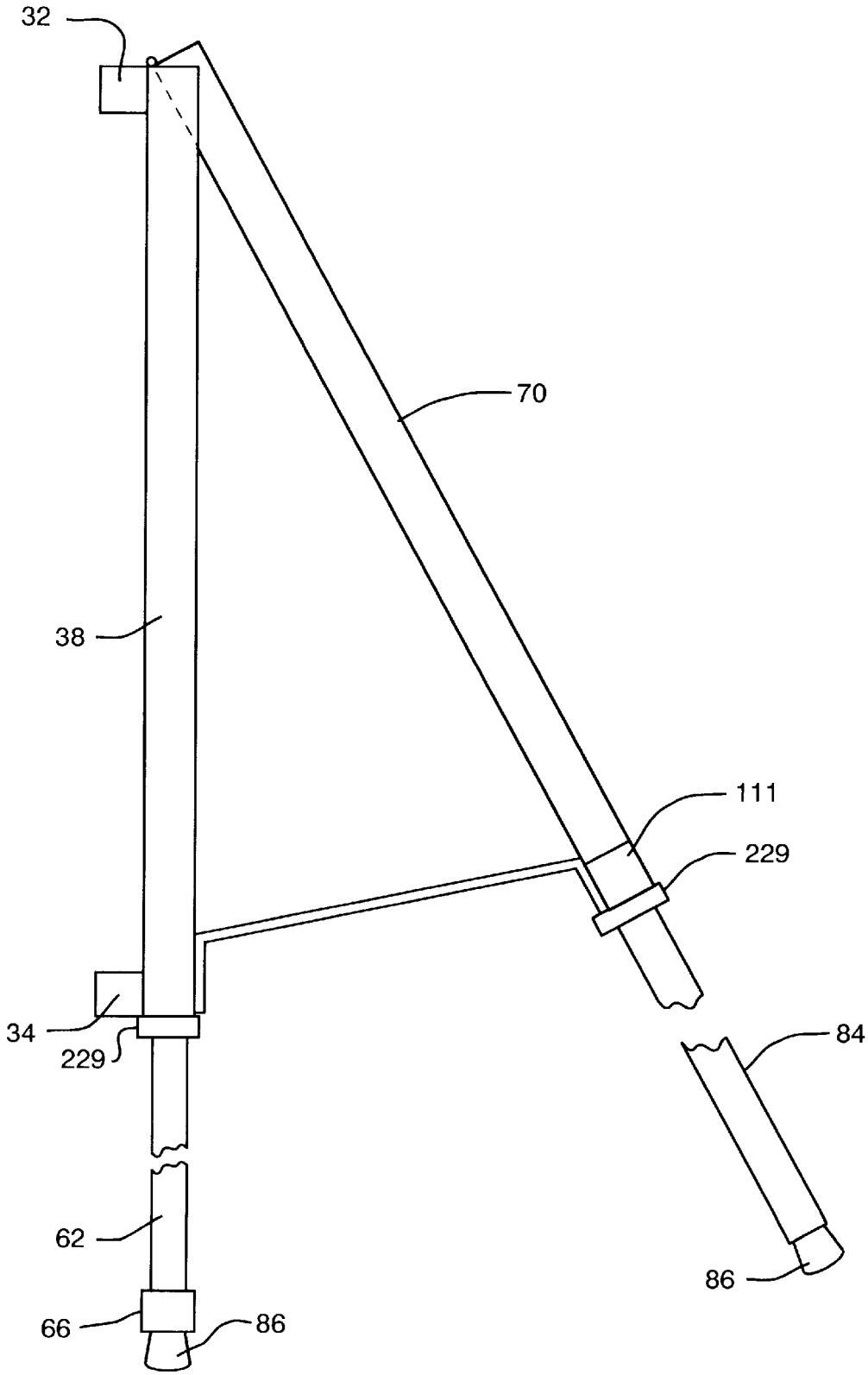
FIG. 7 is a side elevation view of the presentation easel of FIG. 1 showing the legs in an extended position.
Figure 8:
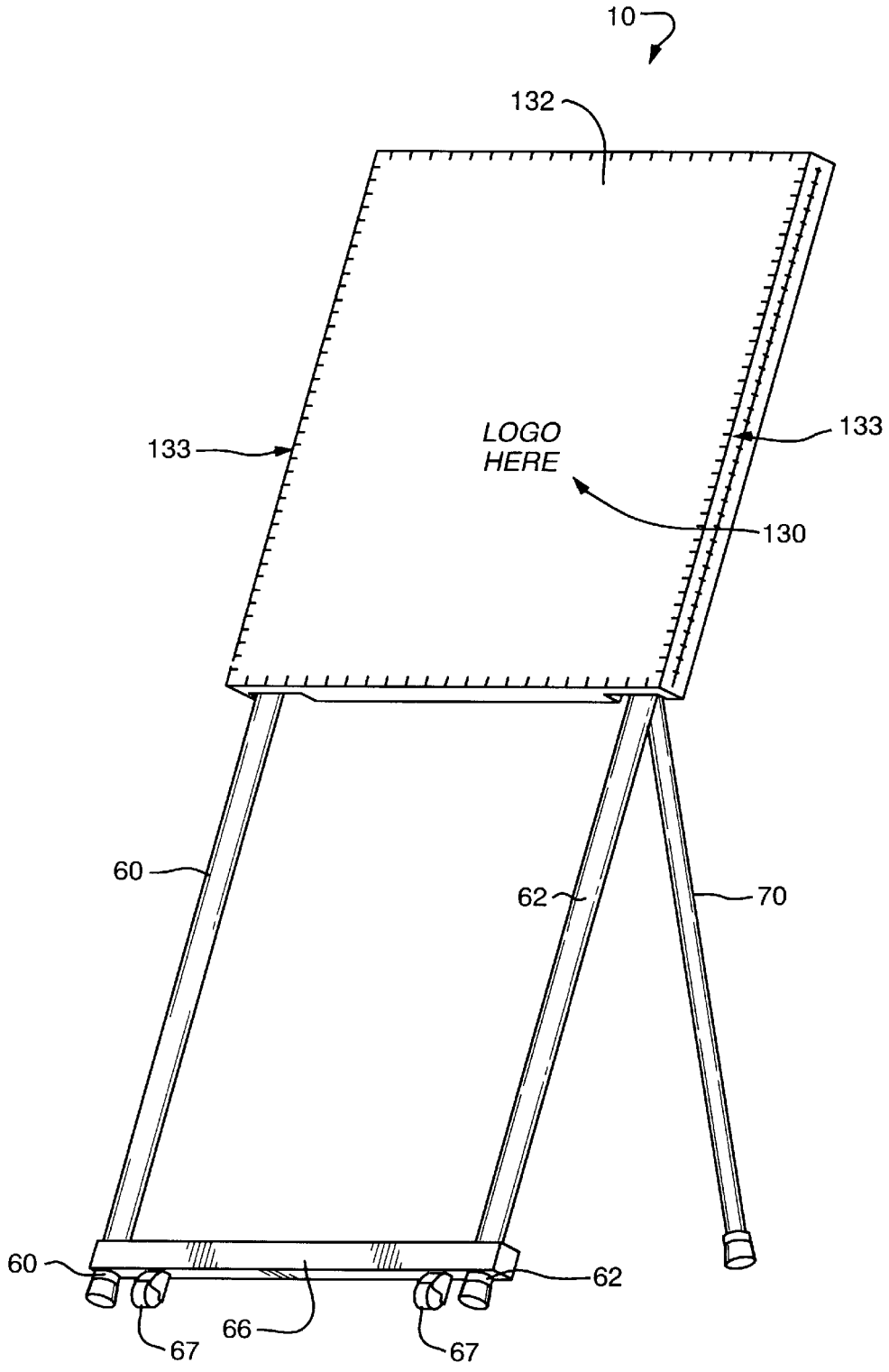
FIG. 8 is a front perspective view of the presentation easel of FIG. 1 including a protective covering with indicia display surface.

Turning to FIGS. 3–4, in a preferred embodiment, presentation easel 10 includes a plurality of storage compartments 140 provided on rear surface 88 of presentation easel 10. In an exemplary embodiment, the plurality of storage compartments 140 comprises a plurality of pouches which are sewn into fabric shell 16 at rear surface 88 and preferably are formed of a fabric material or other suitable material. In a first embodiment, each of the plurality of storage compartments 140 includes an entrance in the form of a zipper 142 formed across rear surface 88 so that a hand of a user may be received within storage compartment 140 to retrieve or dispose and object therein. The plurality of storage compartments 140 may be located at predetermined locations of rear surface 88 and may be of different sizes so as to accommodate different sized objects. In the exemplary illustrated embodiment, there are four storage compartments 140 formed in rear surface 88, wherein two storage compartments 140 are located in an upper half portion of presentation easel 10 proximate first horizontal support member 32 and the other two storage compartments 140 are located in a lower half portion of presentation easel 10 proximate second horizontal support member 34. The two lower storage compartments 140 in the exemplary embodiment have a greater storage area and serve to receive and store intermediate sized items. The two upper storage compartments 140 serve to receive and store smaller sized items. Examples of some of the items which may be stored in the plurality of storage compartments 140 are markers, erasers, tent-cards, handouts, etc.

Alternatively, each of storage compartments 140 includes a fastening device at the entrance thereto. For example, a zipper 144, snaps 146, or other fastening devices on rear surface 88 of presentation easel 10 permit for the installation of a variety of optional sized and shaped accessory items. The size, shape, color, material, and placement of the plurality of storage compartments 140 can be customized to meet the customer's unique needs and desires.

A carrying handle 150 secured to rear surface 88 permits presentation easel 10 to be hand carried vertically or horizontally. Carrying handle 150 may be formed of any suitable material and in one embodiment comprises a nylon handle secured to rear surface 88 by fasteners 151. Furthermore, presentation easel 10 preferably also includes a shoulder strap 160 along sides 20, 24 thereof for providing additional carrying support. Shoulder strap 160 may be formed of similar materials as carrying handle 150, e.g., nylon.

Figure 9:
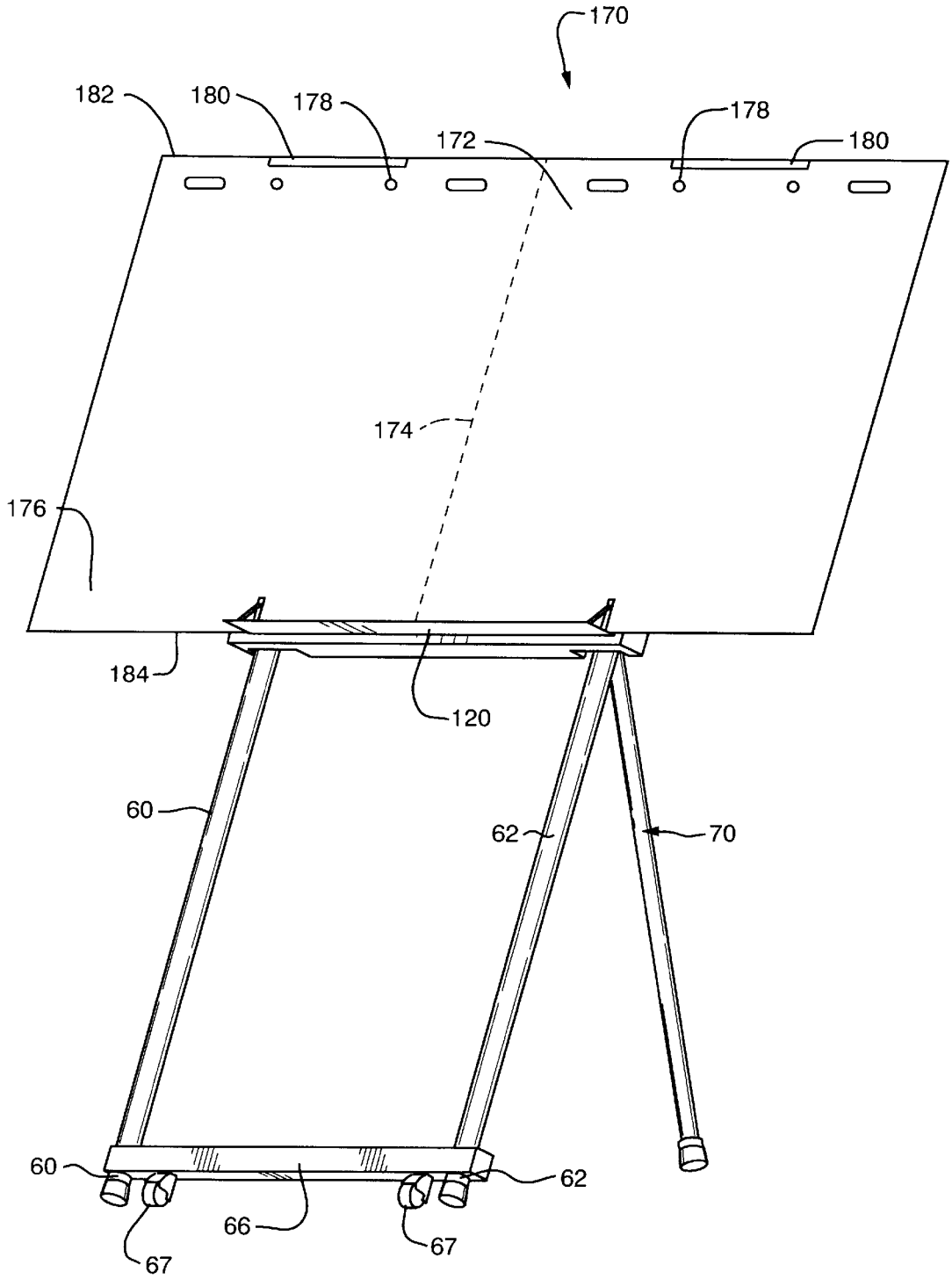
FIG. 9 is a front perspective view of the presentation easel of FIG. 1 having a first attachment attached thereto.

Frame 30 of presentation easel 10 is preferably equipped with several pre-drilled and tapered bores or fasteners for mounting optional accessories firmly in place. Some of these accessories include, but are not limited to, a double-width screen and erasable backboard combination; a fold away shelf that converts presentation easel 10 into a portable podium and wheels and a folding equipment shelf which allows presentation easel 10 to be used in a hand truck configuration. Referring to FIG. 9 in which a first accessory 170 is illustrated. First accessory 170 comprises a double-width flip chart pad holder, erasable writing surface and projection screen (board) 172 which is preferably made of a rigid material like plastic, metal, of fiberboard. Board 172 is hinged at a center axis 174 thereof so that board 172 may be folded and stored in the internal cavity of body 12 when not in use. A first side 176 of board 172 is gloss coated for use as a writing surface for dry or wet erasable markers. In this configuration, first accessory 170 rests directly on front inclined surface 14 of body 12. Board 172 includes a plurality of and in an exemplary embodiment two retaining openings 178 formed therein and axially aligned and spaced apart so that the pair of pins 102 protruding from first horizontal support member 32 are received within the two retaining openings 178 to support and suspend board 172. Retractable folding arms 180 positioned at a top edge 182 of board 172 are designed to angle board 172 away from a top edge (first horizontal support member 32) of inclined front surface 14 of body 12 so that board 172 is vertical rather than inclined. Retractable folding arms 180 are preferably held in place with a hook and loop fastener or other suitable fastener device and a bottom edge 184 of board 172 sits on fabric hinged accessory tray 120.

Figure 10:
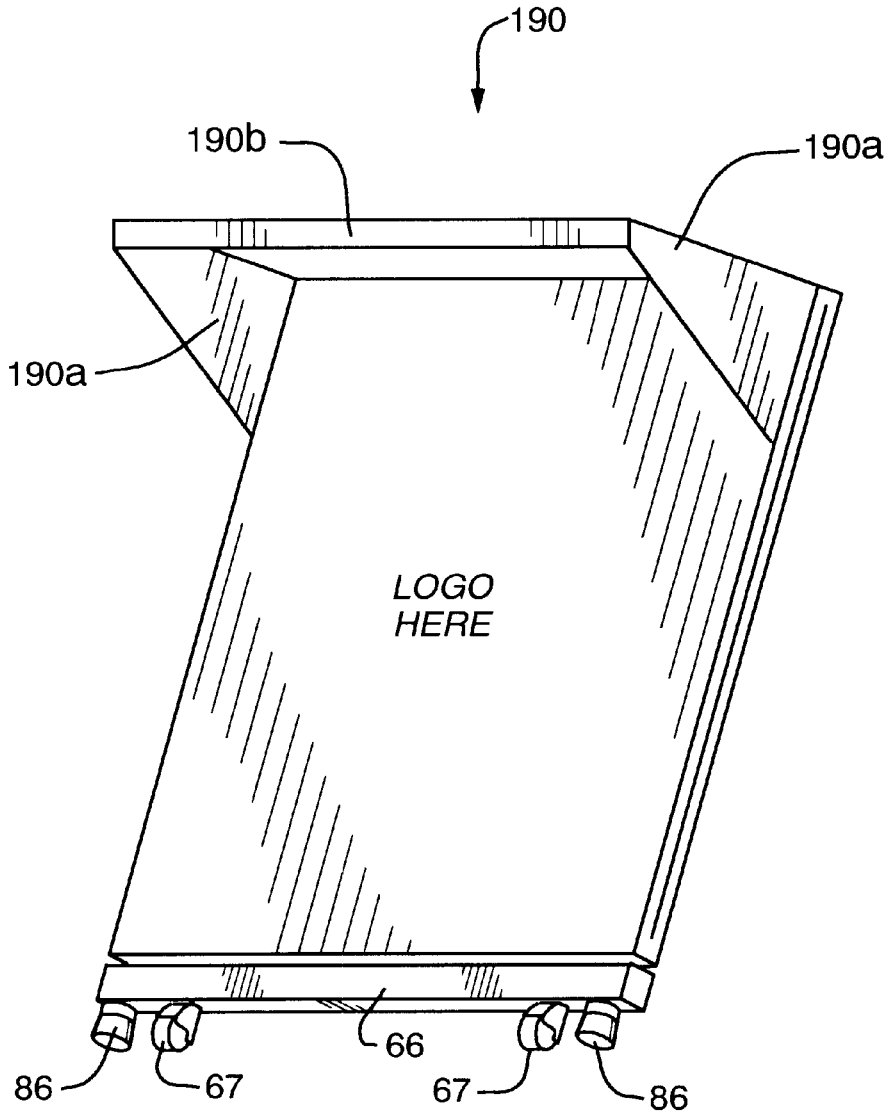
FIG. 10 is a front perspective view of the presentation easel of FIG. 1 showing the easel legs retracted and the protective covering in place with a second attachment attached thereto.

Now turning to FIG. 10, a second accessory is illustrated and generally indicated at 190. Second accessory 190 comprises a fabric covered folding shelf which fixes to the top and rear surface 88 of body 12. Second accessory 190 includes angled sides **190*a* with hook and loop fasteners to provide a rigid shelf support and fabric belting provides a front lip surface 190*b*. With lower leg extensions 60, 62 partially or fully retracted, the combination of easel body 12, first accessory 170 and second accessory 190 turn presentation easel 10** into a portable podium.

Figure 11:
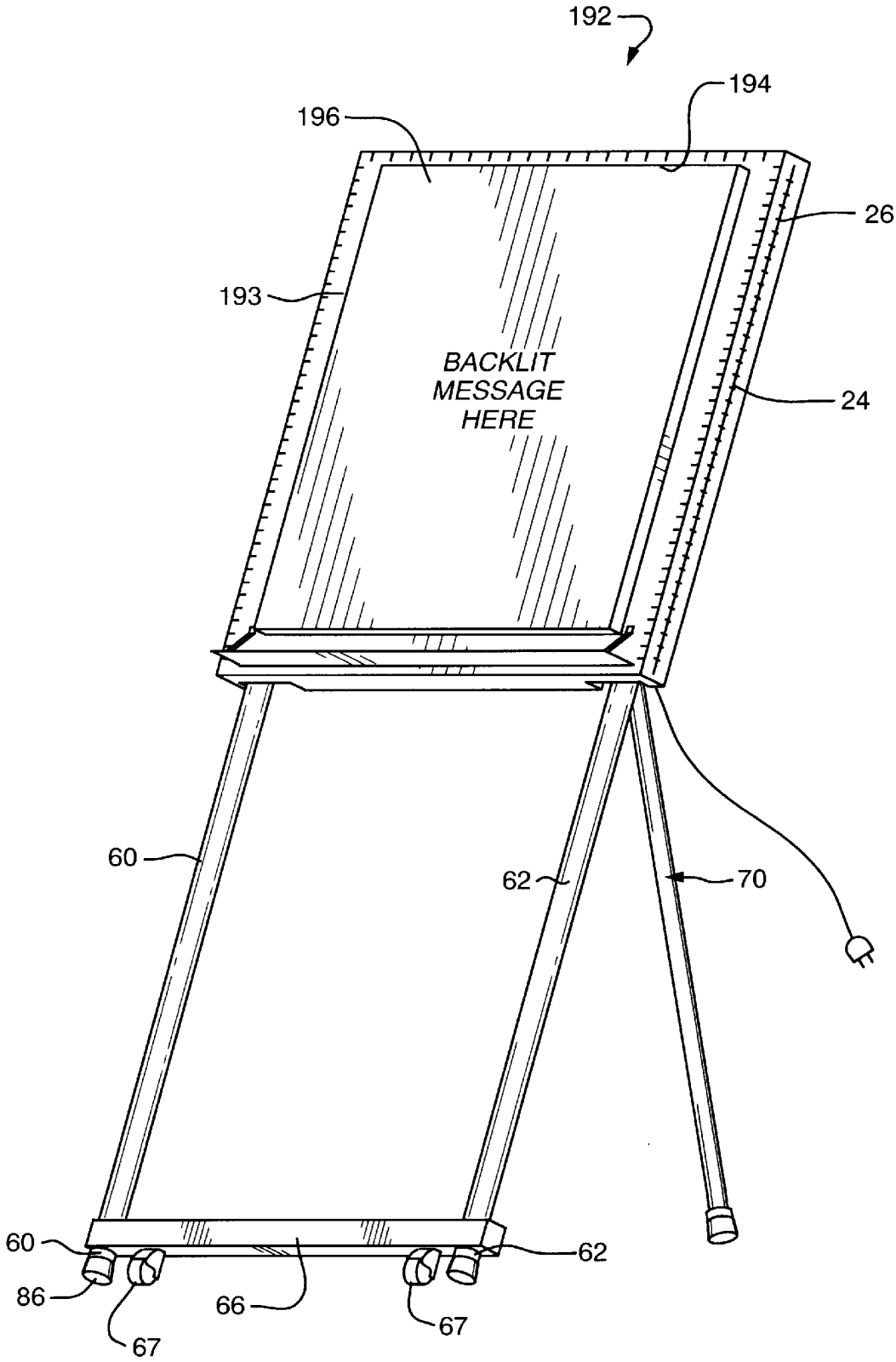
FIG. 11 is a front perspective view of the presentation easel of FIG. 1 with the easel legs extended, wherein the presentation easel includes internal optional components.

Referring now to FIG. 11 in which an alternative configuration of presentation easel 10 is illustrated and is generally indicated at 192. In this embodiment, easel body 12 is provided with a removable front center surface 194 attached to front surface 14 with a hook and loop fastener or similar type fastening device. When removable front center surface 194 is removed, the internal cavity is exposed except for a perimeter edge 193 of fabric shell 16. The internal cavity is accessible via a zippered opening (zipper 26) on a right hand side 24 of presentation easel 10. Internal cavity 194 thus provides a convenient housing for a backlit display board, a computer up-load module, and other electrical and electronic modules generally indicated at 196. For example, a backlit display board 196 may be inserted into the internal cavity by opening side 24 via zipper 26 to thereby provide access to the internal cavity. Backlit display board 196 is then inserted into the internal cavity and because removable front center surface 194 provides a window for viewing, backlit display board 196 shows through the window (removable front center surface 194). Suitable materials are used for backlit display board 196 and in an exemplary embodiment, backlit display board 196 is formed of a plexiglass material with lighting devices disposed within backlit display board 196 so that light shines through the plexiglass material when the lighting devices is activated.

Figure 12:
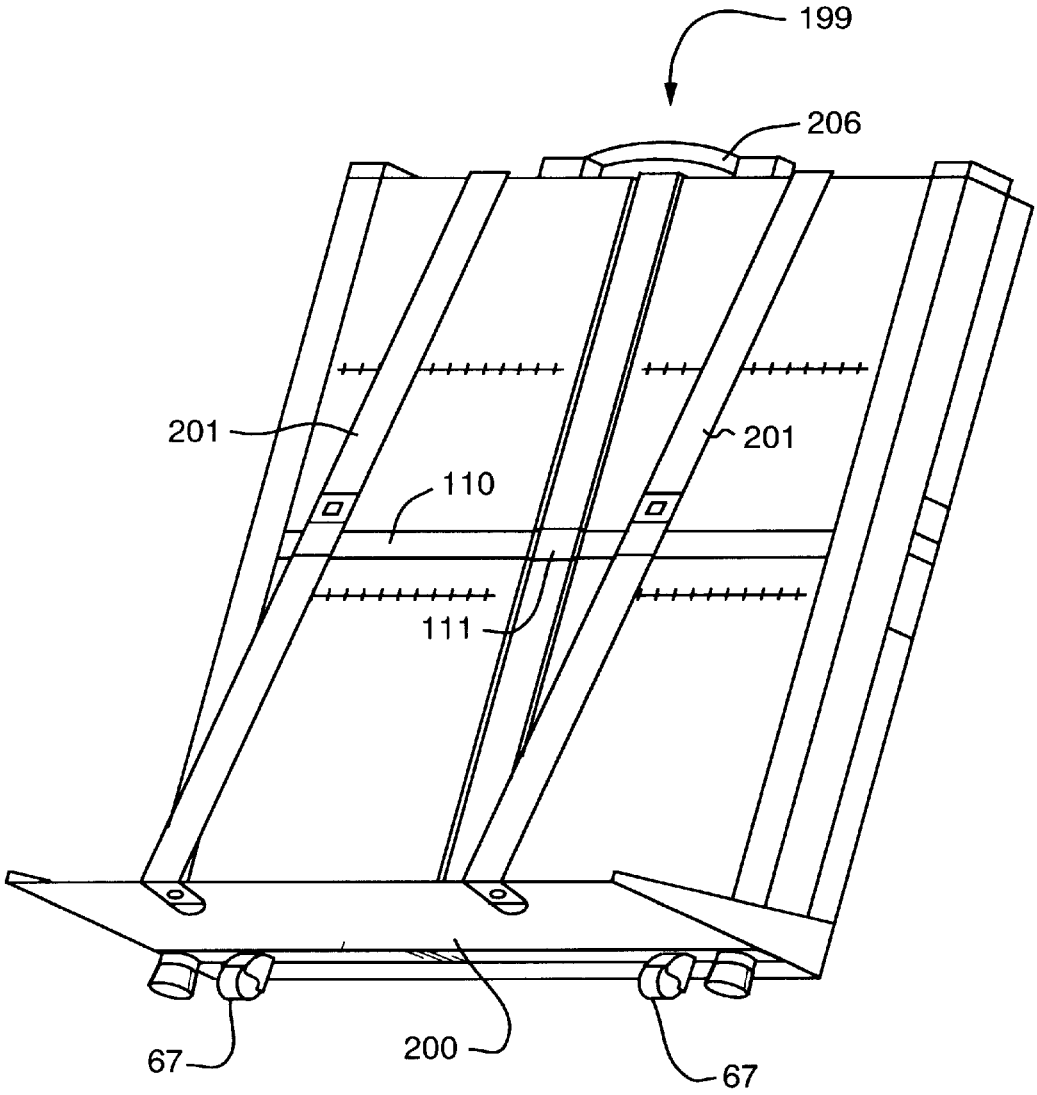
FIG. 12 is a rear perspective view of the presentation easel of FIG. 1 with a fold-down carry platform for use in a hand-truck configuration.

Referring now to FIG. 12 in which presentation easel 10 is shown for use in a hand truck configuration. In this embodiment, fixed wheels 67 are used for transporting presentation easel 10 from one place to another without having to carry presentation easel 10. A fold down platform 200 and attachments for hold down straps 201 permits presentation easel 10 to be used as a hand truck for carrying additional flip charts, pads, audio-visual equipment, and other items. Handle 206 secured to first horizontal support member 32 (FIG. 2) permits presentation easel 10 of this embodiment to be easily lifted, carried, and/or transported.

Figure 13:
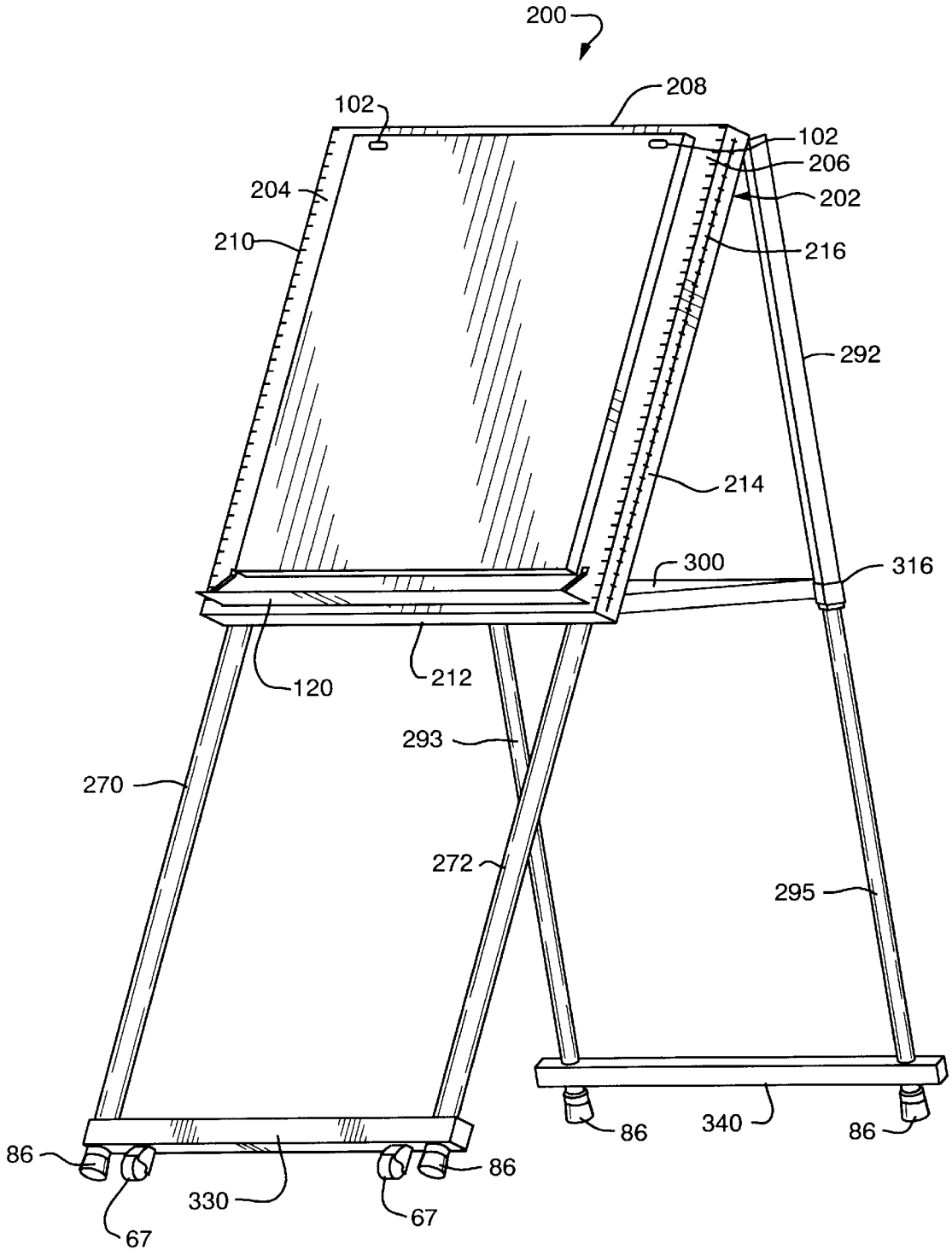
FIG. 13 is a front perspective view of a second embodiment of a presentation easel of the present invention.

Now referring to FIGS. 13–16. FIG. 13 is a front perspective view of a second embodiment of a presentation easel of the present invention and is generally indicated at 200. Presentation easel 200 includes a main body 202 which includes a main viewing and support surface 204. Preferably main body 202 comprises a fabric body sewn in the form of a rectangular box that forms a soft, outer, single piece shell 206. Shell 206 is closed on three sides 208, 210, 212 and has a fourth side 214 which may be opened using a suitable device such as a zipper 216. In other words, in the exemplary embodiment, zipper 216 is employed in fourth side 214 so that material forming fourth side 214 may be least partially opened to permit access to an internal cavity (not shown in FIG. 13) formed within shell 206. Shell 206 is formed of suitable materials and in a preferred embodiment comprises a fabric material, more preferably a nylon material.

Figure 14:
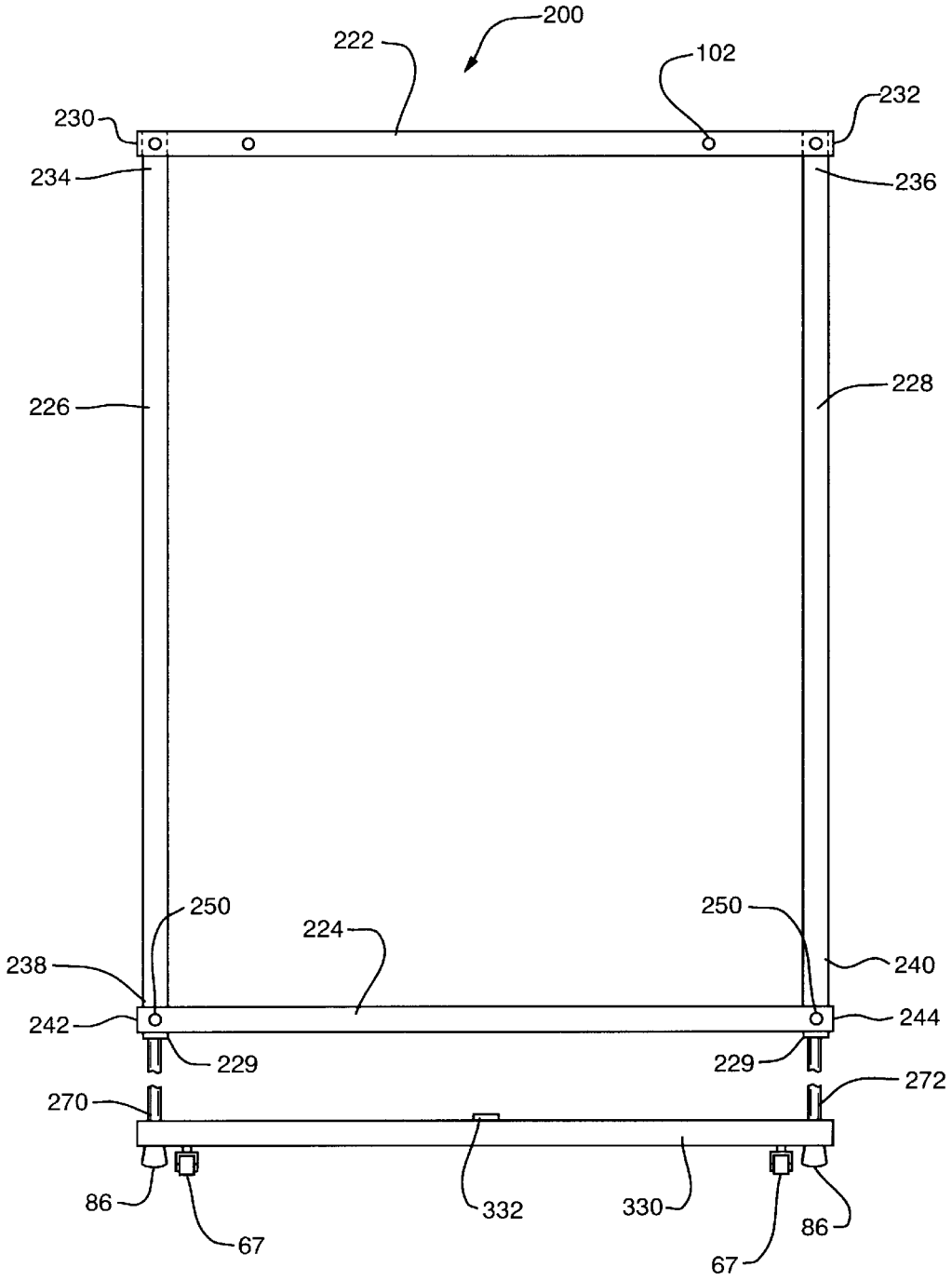
FIG. 14 is a partially fragmented front elevation view of the presentation easel of FIG. 13.
Figure 15:
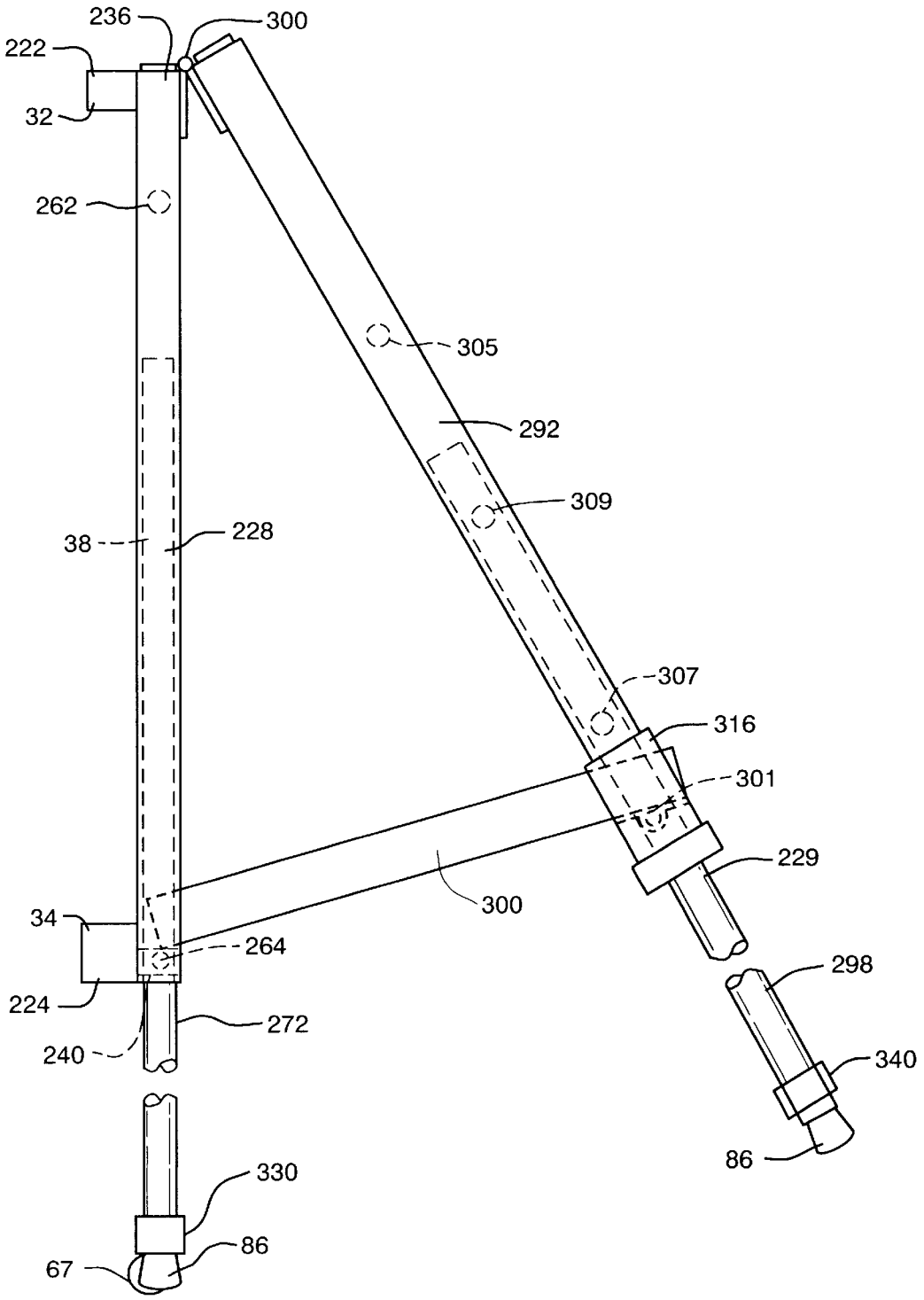
FIG. 15 is a side elevation view of the presentation easel of FIG. 13.

Body 202 has a frame generally indicated at 220, wherein frame 220 supports shell 206 and shapes shell 206 so that body 202 is in the form of a rectangular box. As best shown in FIGS. 14–15, frame 220 frame includes a first horizontal support member 222 which preferably comprises an elongated rectangular tube. In one exemplary embodiment, first horizontal support member 222 comprises a 1"×2" aluminum rectangular tube. It is understood that any other suitable material may be used and the above-mentioned dimensions and shape are recited only for the purpose of illustration. In the illustrated embodiment, first horizontal support member 222 comprises a top portion of body 202. An opposing second horizontal support member 224 comprises a bottom portion of body 202 and preferably is identical to or very similar to first horizontal support member 222, namely an elongated rectangular tube. Body 202 also includes first and second vertical support members 226, 228 which run vertically along the outside of shell 206 and serves as fixed leg outer housings. First and second vertical support members 226, 228 intersect and are connected to first horizontal support member 222 at first and second ends 230, 232 of first horizontal support member 222. More specifically, first and second ends 230, 232 of first horizontal support member 222 are connected through shell 206 to upper end portions 234, 236 of first and second vertical support members 226, 228.

Likewise, bottom end portions 238, 240 of first and second vertical support members 226, 228, respectively, are attached to first and second ends 242, 244 of second horizontal support member 224 through fabric shell 206. Any suitable number of fastening devices 250 may be used to attach first and second horizontal support members 222, 224 to first and second vertical support members 226, 228. First and second horizontal support members 222, 224 extend across the end portions of first and second vertical support members 226, 228 in contrast to only extending between first and second vertical support members 226, 228.

First and second vertical support members 226, 228 each include a pair of side bores formed therein. For purpose of illustration and clarity, only second vertical support member 228 will be described in greater detail. It being understood that first vertical support member 226 is identical to second vertical support member 228. More specifically, an upper side bore 262 is formed proximate upper end 236 of second vertical support member 228. A lower side bore 264 is formed in second vertical support member 228 proximate both bottom end portion 240 of second vertical support member 228 and end 244 of second horizontal support member 224. Preferably, upper and lower side bores 262 and 264 have a circular shape. First and second vertical support members 226, 228 each include an end cap 229 which is disposed at bottom end portion 240 thereof. End cap 229 preferably comprises a plastic rectangular end cap 229 which has a central opening communicating with the opening extending through each of first and second vertical support members 226, 228.

Body 202 includes first and second lower front leg extensions 270, 272 which are retractably received within first and second vertical support members 226, 228, respectively. More specifically, because of the tubular nature of first and second vertical support members 226, 228, first and second lower front leg extensions 270, 272 are received therein. First and second lower front leg extensions 270, 272 are mechanically locked into first and second vertical support members 226, 228, respectively, so that first and second lower front leg extensions 270, 272 slidably travel within first and second vertical support members 226, 228. First and second lower front leg extensions 270, 272 each include a retractable locking mechanism 280 which serve to lock first and second lower front leg extensions 270, 272 in either a retracted position or an expanded position. More specifically, first and second lower front leg extensions 270, 272 are locked in the retracted position by moving first and second lower front leg extensions 270, 272 within first and second vertical support members 226, 228 so that locking mechanism 280 serves to lock first and second vertical support members 226, 228. In one exemplary embodiment, locking mechanism 280 comprises a spring loaded pin which is positioned within each of first and second lower front leg extensions 270, 272 proximate upper ends, respectively thereof. As first and second lower front leg extensions 270, 272 travel upward in first and second vertical support members 226, 228, locking mechanism 280 biases against an inner surface of first and second vertical support members 226, 228. Once locking mechanism 280 encounters upper side bore 262, the spring loaded pin is axially aligned with and extends through upper side bore 262 so that the spring loaded pin at least partially extends through upper side bore 262 and preferably extends through upper side bore 262 so that a tip portion of the spring loaded pin extends through and clears first and second vertical support members 226, 228 to lock first and second lower front leg extensions 270, 272 in place in retracted position.

Similarly, to lock first and second lower front leg extensions 270, 272 in the extended position, first and second lower front leg extensions 270, 272 are pulled in a direction away from bottom ends 238, 240 of first and second vertical support members 226, 228. As first and second lower front leg extensions 270, 272 travel away from bottom ends 238, 240, locking mechanism 280 biases against an inner surface of first and second vertical support members 226, 228. Once locking mechanism 280 encounters lower side bore 264, the spring loaded pin is axially aligned with and extends through lower side bore 264 so that the spring loaded pin at least partially extends through lower side bore 264 and preferably extends through lower side bore 264 so that a tip portion of the spring loaded pin extends through and clears first and second vertical support members 226, 228 to lock first and second lower front leg extensions 270, 272 in place in extended position.

Presentation easel 200 also includes retractable, hinged rear leg assembly which include first and second rear leg members 290, 292, respectively. In the FIGURES, only second rear leg member 292 is shown; however, it is understood that first rear leg 290 is identical thereto. First and second rear leg members 290, 292 are preferably identical to first and second vertical support members 226, 228. Each of first and second rear leg members 290, 292 includes an upper end 294 and an opposing lower end 296. Upper ends 294 are hinged to a rear surface of first and second front vertical support members 226, 228 proximate upper ends 234, 236 thereof proximate first horizontal support member 222. Hinge 300 permits first and second rear leg members 290, 292 to be angled relative to first and second vertical support members 226, 228 so that presentation easel 200 can take the form illustrated in FIG. 15. First and second rear leg members 290, 292 each include a stopper 229. Stopper 229 preferably comprises a plastic rectangular end cap having a central opening which receives lower ends 238, 240 of first and second rear leg members 290, 292.

The retractable, hinged rear leg assembly also includes first and second lower rear leg extensions 293, 295 which are preferably identical to or similar to lower front leg extensions 270, 272. First and second lower rear leg extensions 293, 295 are retractably received within first and second rear leg members 290, 292, respectively. More specifically, because of the tubular nature of first and second rear leg members 290, 292, first and second lower rear leg extensions 293, 295 are received therein. First and second lower rear leg extensions 293, 295 are mechanically locked into first and second rear leg members 290, 292, respectively, so that first and second lower rear leg members 290, 292 slidably travel within first and second rear leg members 290, 292. First and second lower rear leg extensions 293, 295 each include retractable locking mechanism 280 to lock first and second lower rear leg extensions 293, 295 in either a retracted position or an expanded position. More specifically, first and second lower rear leg extensions 293, 295 are locked in the retracted position by moving first and second lower rear leg extensions 293, 295 within first and second rear leg members 290, 292 so that locking mechanism 280 serves to lock first and second rear leg extensions 293, 295. In one exemplary embodiment, locking mechanism 280 comprises a spring loaded pin which is positioned within each of first and second lower rear leg extensions 293, 295 proximate upper ends thereof. As first and second lower rear leg extensions 293, 295 travel upward in first and second rear leg members 290, 292, locking mechanism 280 biases against an inner surface of first and second rear leg members 290, 292. First and second rear leg members 290, 292 include a lower side bore 301 proximate lower ends thereof.

Once locking mechanism 280 encounters lower side bore 301, the spring loaded pin is axially aligned with and extends through lower side bore 301 so that the spring loaded pin at least partially extends through lower side bore 301 and preferably extends through lower side bore 301 so that a tip portion of the spring loaded pin extends through and clears first and second rear leg members 290, 292 to lock first and second lower rear leg extensions 293, 295 in place in retracted position.

Figure 16:
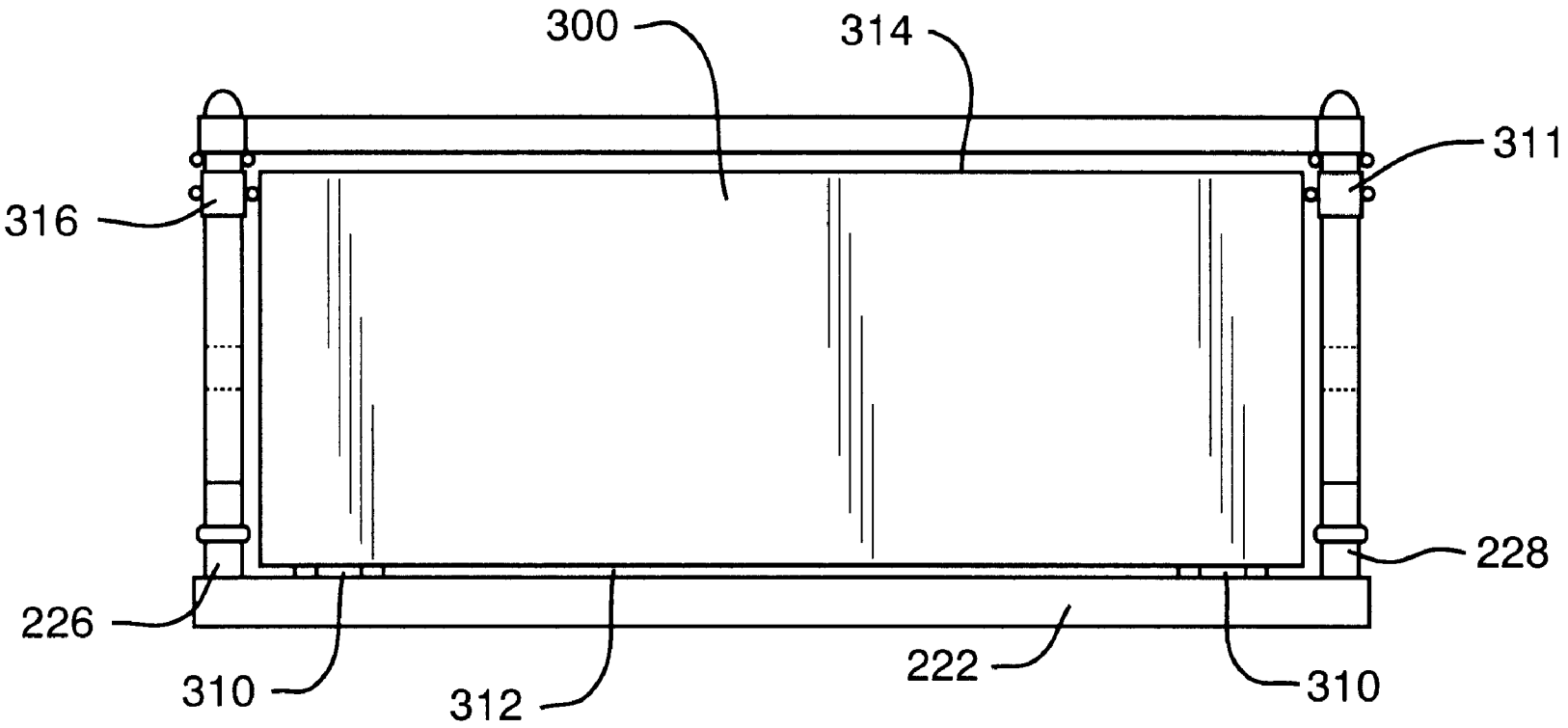
FIG. 16 is a top plan view of the presentation easel of FIG. 13.
Figure 17:
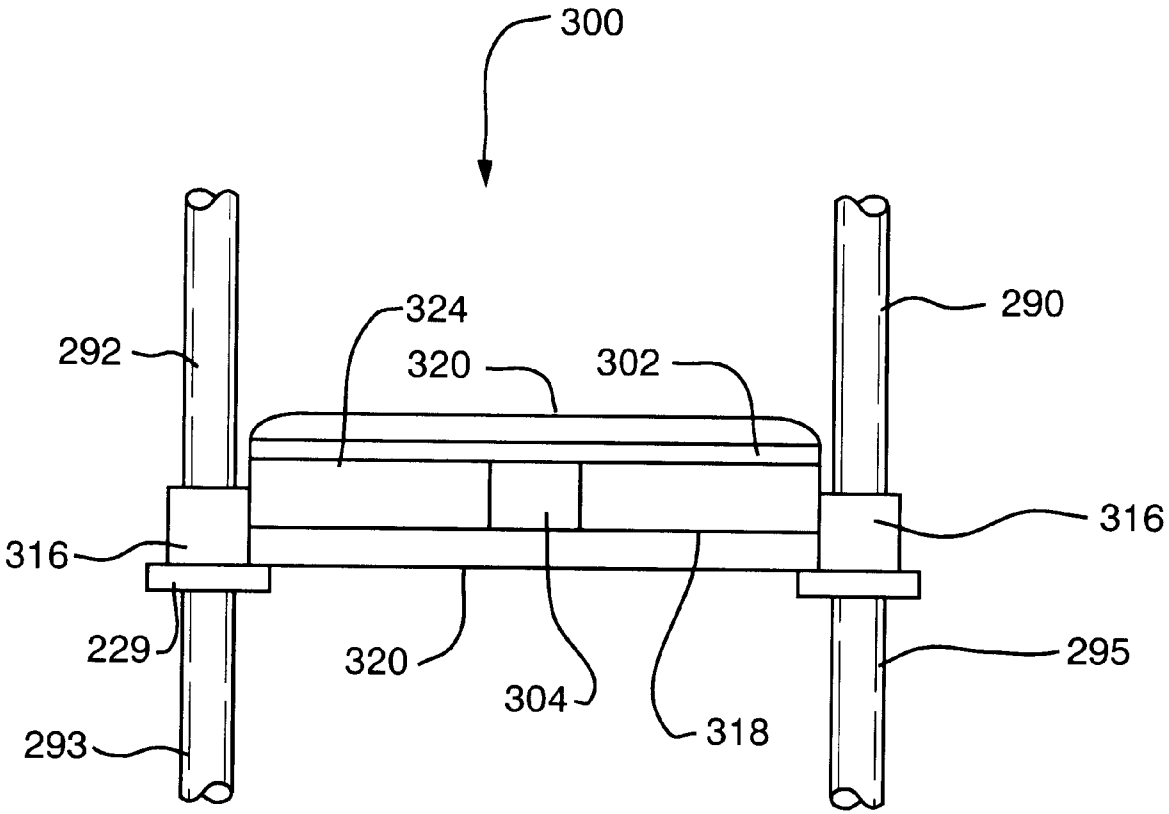
FIG. 17 is a side cross sectional view of a shelf used in the presentation easel of FIG. 13.
Figure 18A:
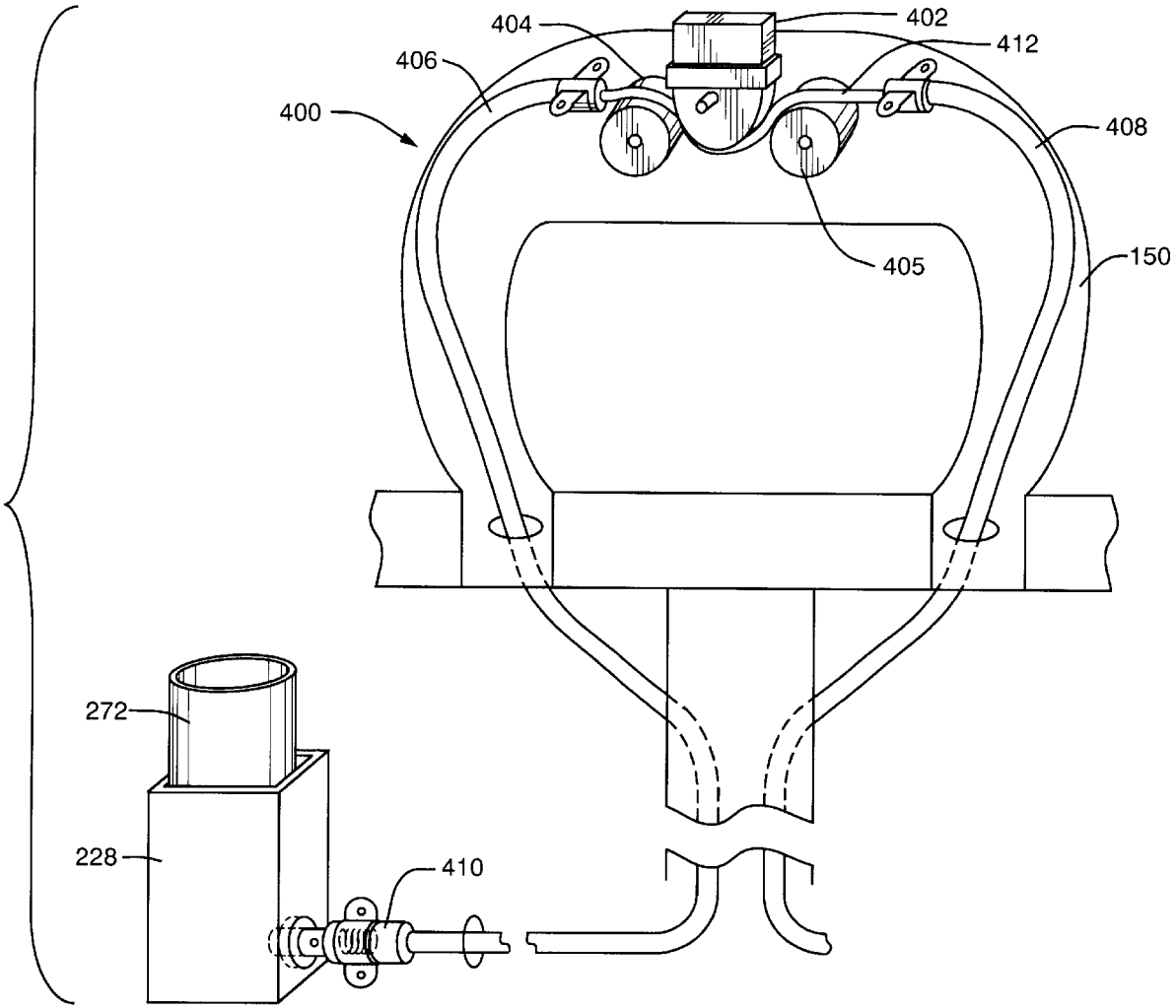
FIG. 18A is an exploded perspective view of a portion of the push button assembly of FIG. 18.
Figure 18B:
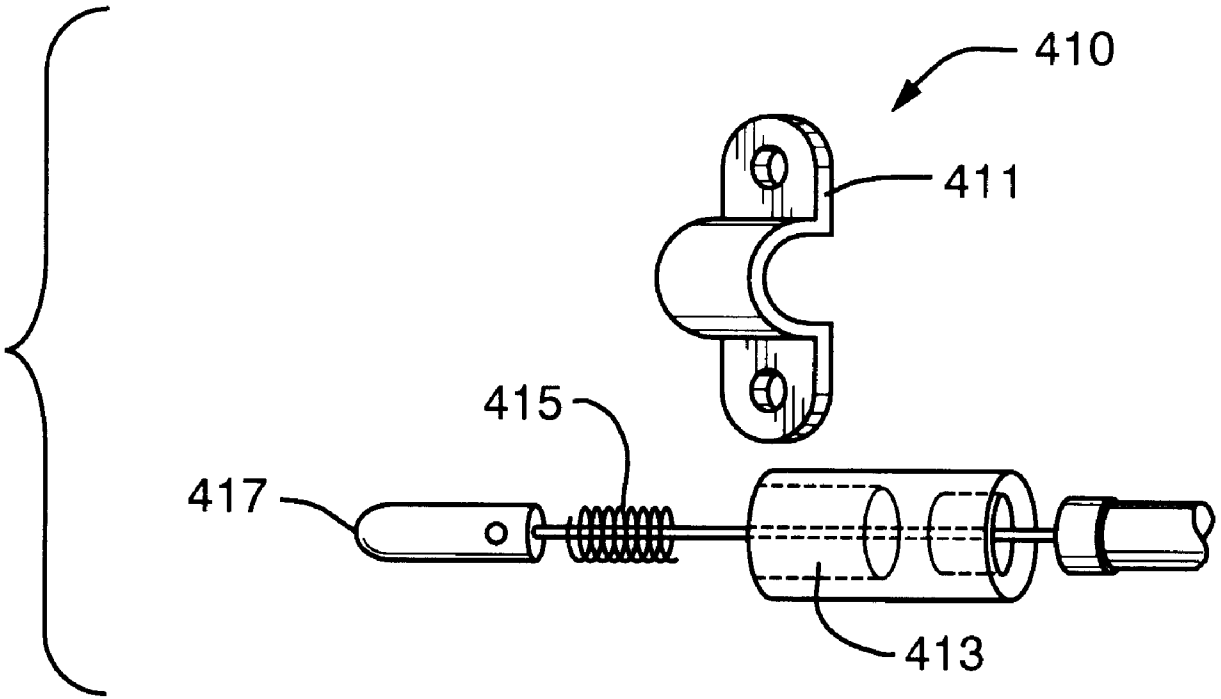
FIG. 18 is a partial perspective view of a first push button assembly for use with the presentation easel of FIG. 13.
Figure 19:
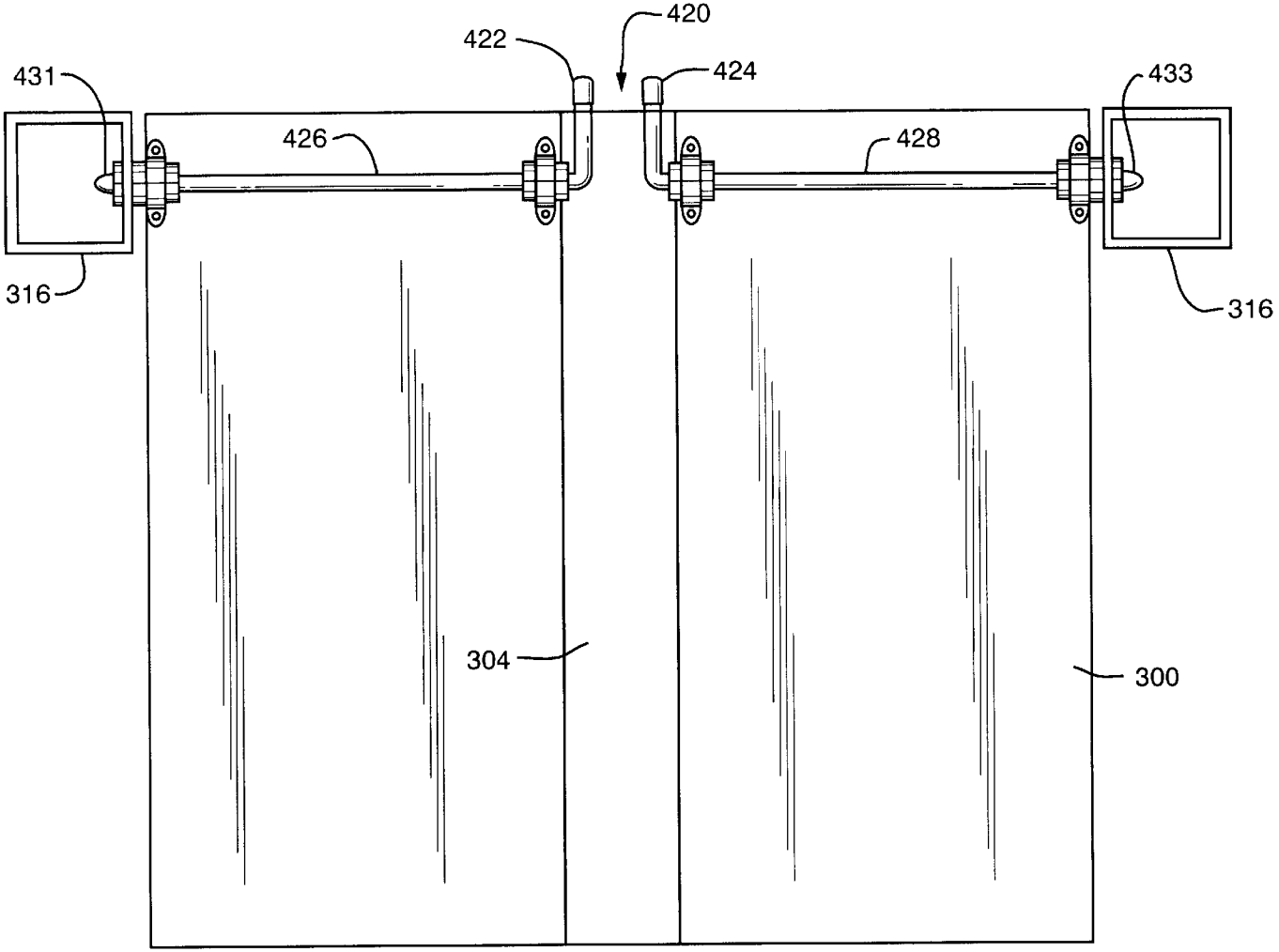
FIG. 19 is a top plan view of a second push button assembly for use with the presentation easel of FIG. 13.

Presentation easel 200 includes a fold down shelf 300 which extends between first and second vertical support members 226, 228 and first and second rear leg members 290, 292. As best shown in FIGS. 16 and 17, fold down shelf 300 includes an upper platform 302 which is formed of a rigid material. In an exemplary embodiment, upper platform 302 is formed of wood or plastic and is generally rectangular in shape. Fold down shelf 300 has a center beam 304 which extends the width of fold down shelf 300 from first and second rear leg members 290, 292 to first and second vertical support members 226, 228. In an exemplary embodiment, center beam 304 is a rectangular tubular member. Shelf 300 has a fold down capability and has a pair of hinges 310 which connect one end 312 of shelf 300 to first and second vertical support members 226, 228 proximate bottom end portions 238, 240. Another end 314 of shelf 300 is connected to first and second rear leg members 290, 292 by a pair of shelf slides 316. Each of the pair of shelf slides 316 preferably comprises a rectangular plastic tubular member which slidably travels along an outer surface of first and second rear leg members 290, 292. A rod 318 extends between each of the pair of shelf slides 316 and connects the pair of shelf slides 316. Rod 318 is generally parallel to upper platform 302, wherein center beam 304 is intermediate rod 318 and upper platform 302.

Shelf 300 includes a fabric shell 320 which is disposed around upper platform 302, center beam 304, and rod 318. Fabric shell 320 is preferably formed of the same material as shell 206 of body 302. Thus, fabric shell 320 has a central cavity 324 formed between the material forming fabric shell 320. Fabric shell 320 includes an end flap 322 which provides access to central cavity 324. Central cavity 324 provides a storage area to store items, accessories, and the like.

Presentation easel 200 further includes a front cross support member 330 which extends between the bottom ends of first and second lower front leg extensions 270, 272. At a top surface thereof, front cross support member 330 includes a leg lock assembly 332 which serves to lock first and second lower front leg extensions 270, 272 to first and second rear leg members 290, 292 in place when presentation easel 200 is being stored or transported whereby first and second vertical support members 226, 228 and first and second rear leg members 290, 292 are generally parallel to one another. Leg lock assembly 332 in an exemplary embodiment comprises an L-shaped locking member which latches onto a rear cross support member 340 which is similar to front cross support member 330 to lock front cross support member 330 and rear cross support member 340. Front and rear cross support members 330 and 340 each include a pair of wheels (casters) 67 to permit presentation easel 200 to be easily transportable. Casters 67 are designed so that when presentation easel 200 rests on the ground, the feet 86 contact the ground and casters 67 are slightly raised in relation to feet 86 so that feet 86 engage the ground. By slightly tilting presentation easel 200 forward to thereby engage casters 67 with the ground the easel may be transported permitting presentation easel 200 to travel across the ground.

In a first position best shown in FIG. 15, shelf 300 is in a first position in which shelf 300 is in a folded down state extending between first and second vertical support members 226, 228 and first and second rear leg members 290, 292. In this first position, the pair of shelf slides 316 seat against stoppers 229 which maintain shelf 300 in a generally horizontal position relative to the ground thereby permitting items to be disposed on shelf 300 during the use of presentation easel 200 and to store items in central cavity 324 (FIG. 17). To open presentation easel 200 into this first position, first and second rear leg members 290, 292 are hingedly opened in a direction away from first and second vertical support members 226, 228. As first and second rear leg members 290, 292 are opened, shelf slides 216 are directed downward toward stoppers 296 resulting in shelf 300 assuming a generally horizontal and parallel position relative to the ground.

Now turning to FIGS. 13–19 in which a third embodiment of the presentation easel of the present invention is presented. In this embodiment, locking mechanism 280 is modified so that a pair of push button assemblies 400, 420 are provided. First push button assembly 400 is designed to engage and disengage first and second lower front leg extensions 270, 272 from first and second vertical support members 226, 228. First push button assembly 400 comprises a button 402, a first roller 404, a first cable 406, a second roller 405, and a second cable 408, and spring loaded pin assemblies 410. First button assembly 400 is preferable housed within handle 150 (shown in FIG. 21) and is designed so that first and second cables 406, 408 travel within shell 316 down fabric trim stitching and along horizontal support member 224 (FIG. 14). When button 402 is actuated (depressed), a wire 412 within cables 406, 408 is pulled over rollers 404, 405 in a direction toward push button 402 causing spring-loaded pins 410 to retract also in a direction toward first end of cables 406, 408. This movement of retracting spring-loaded pin assemblies 410 permits movement of first and second lower front leg extensions 270, 272 within first and second vertical support members 226, 228. FIG. 18A is an exploded perspective view of spring loaded pin assembly 410. First button assembly 400 includes clamps 411 to mount the hardware thereof within handle 150. Spring loaded pin assembly 410 includes a threaded shaft 413 and spring 415 which act to retract pin 417 when button 402 is actuated.

Referring to FIGS. 15 and 19–20A, second push button assembly 420 comprises a first lever 422, a second lever 424, a first bar 426, a second bar 428, and spring loaded pin assemblies 431, 433. Second button assembly 420 is preferably housed within shelf 300 and more preferably first lever 422 and second lever 424 are disposed within center beam 304 and spring loaded pin assemblies 431, 433 extend outwardly from shelf 300 at corners thereof. The pair of first spring loaded pin assemblies 431, 433 act to lock shelf 300 into place in first and second rear leg members 290, 292.

Figure 20A:
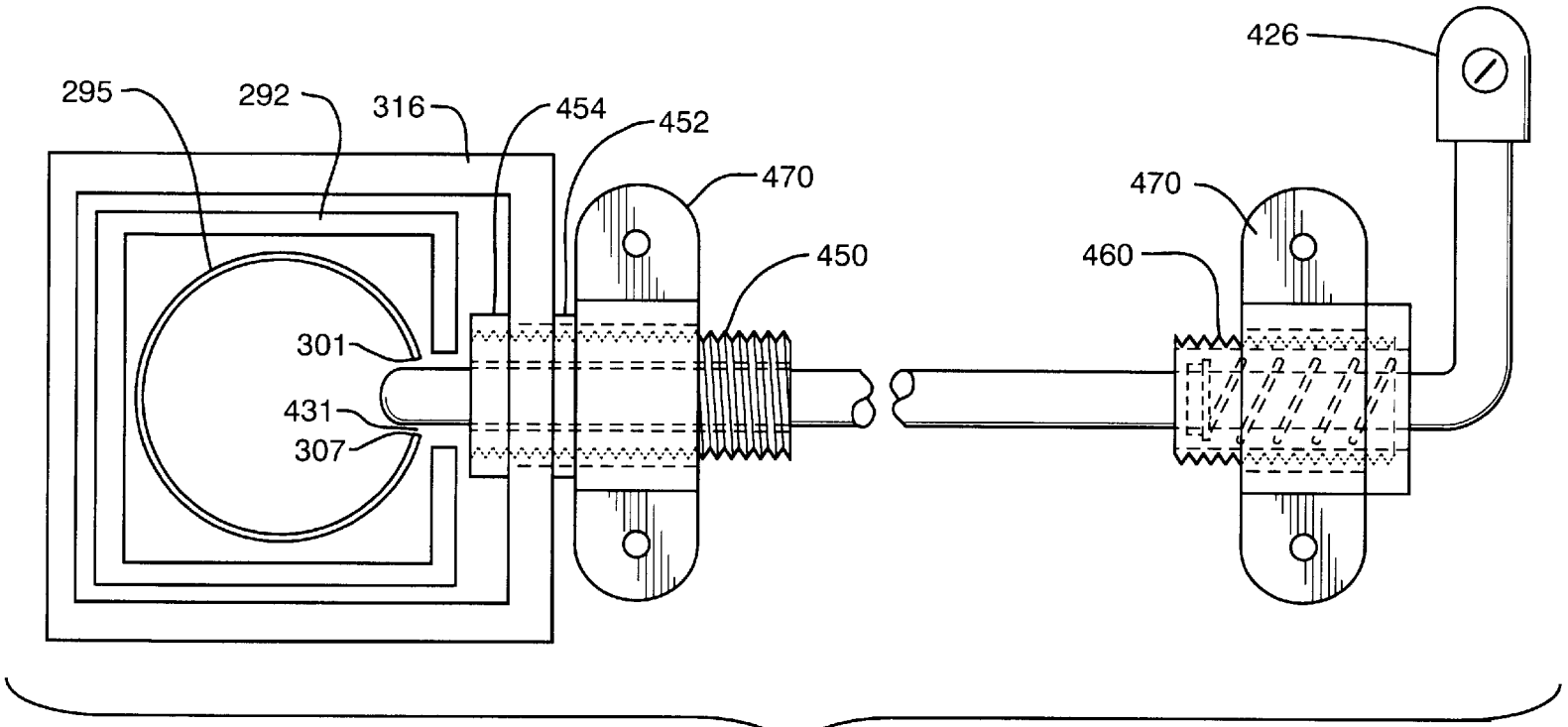
FIG. 20A is an enlarged top plan view of a portion of the second push button assembly of FIG. 19.
Figure 20B:
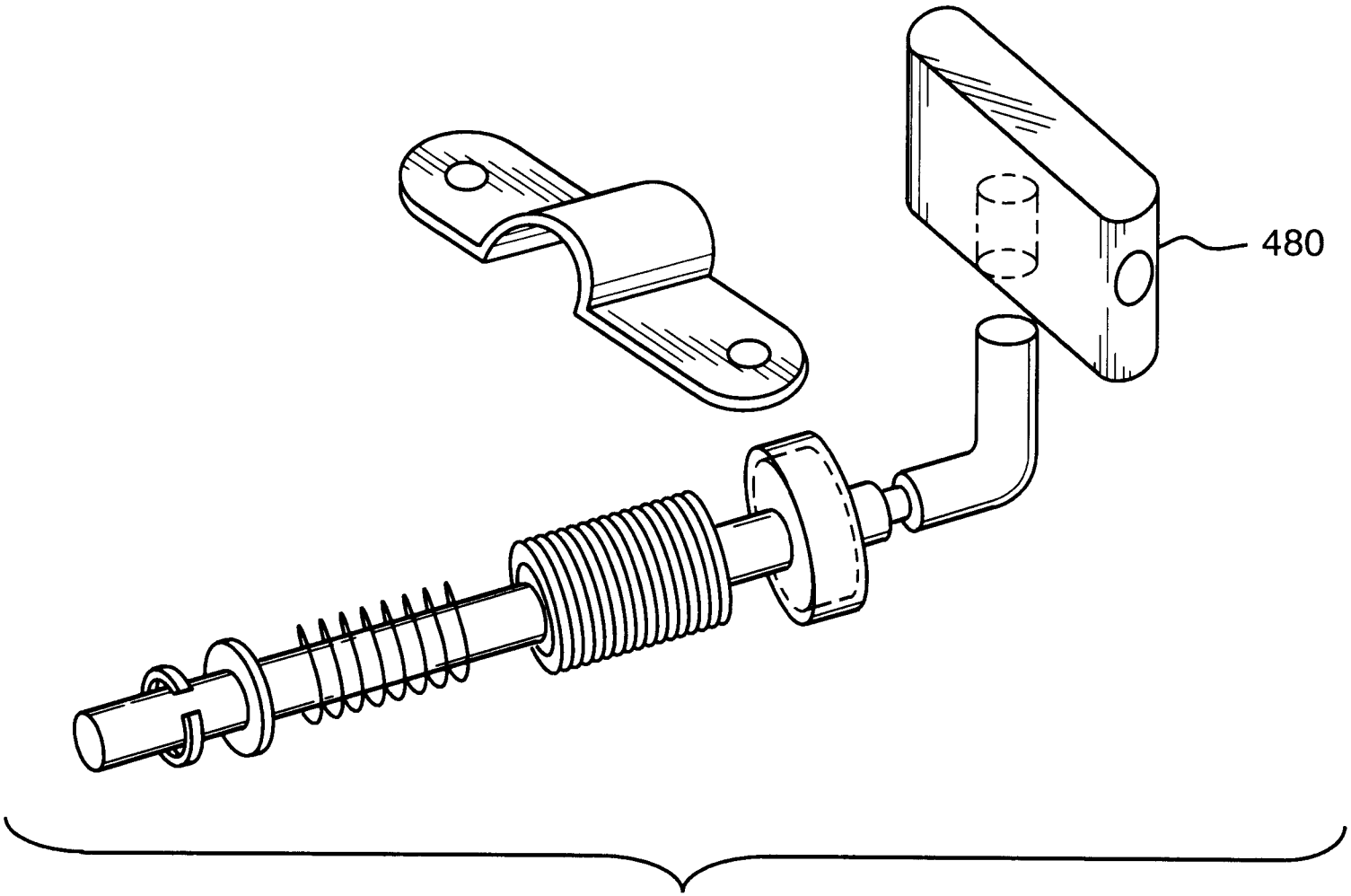
FIG. 20B is an exploded perspective view of a portion of the second push button assembly of FIG. 20A.

FIGS. 20A and 20B illustrate greater detail of the spring loaded pin assemblies 431, 433. Second button assembly 430 includes first threaded shafts 450 and second threaded shafts 460, all of which are fastened to the top surface of shelf 300 by clamps 470. Threaded shafts 450 protrudes beyond ends of shelf 300 and into slide 316, separated by a washer 452. The end of threaded shafts 450 are fastened into place by a nut 454. The other threaded shafts 460 are secured to shelf 300 proximate center beam 304 by clamp 470.

In the shelf down, legs fully extended position, spring loaded pin assemblies 431, 433 protrude through aligned side bores 301 (in rear leg members 290, 292) and a side bore 309 formed in lower rear leg extensions 293, 295 locking shelf 300 in the down position and the rear leg extensions 293, 295 fully extended. When levers 422, 424 are compressed, bars 426, 428 move toward center beam 304, retracting spring loaded pin assemblies 431, 433 out of side bores 301, 309. This permits rear leg members 290, 292 to move in and slide 316 to move upwardly until spring loaded pin assemblies 431, 433 locate side bore 305, at which point the rear leg assemblies 290, 292 lock in the closed position when shelf 300 is up. When lower rear leg extensions 293, 295 are retracted and holes 305 and 307 align, spring loaded pin assemblies 431, 433 extend through the rear leg members 290, 292 and lower rear leg extensions 293, 295, locking presentation easel 200 in the closed position for transport.

Figure 21:
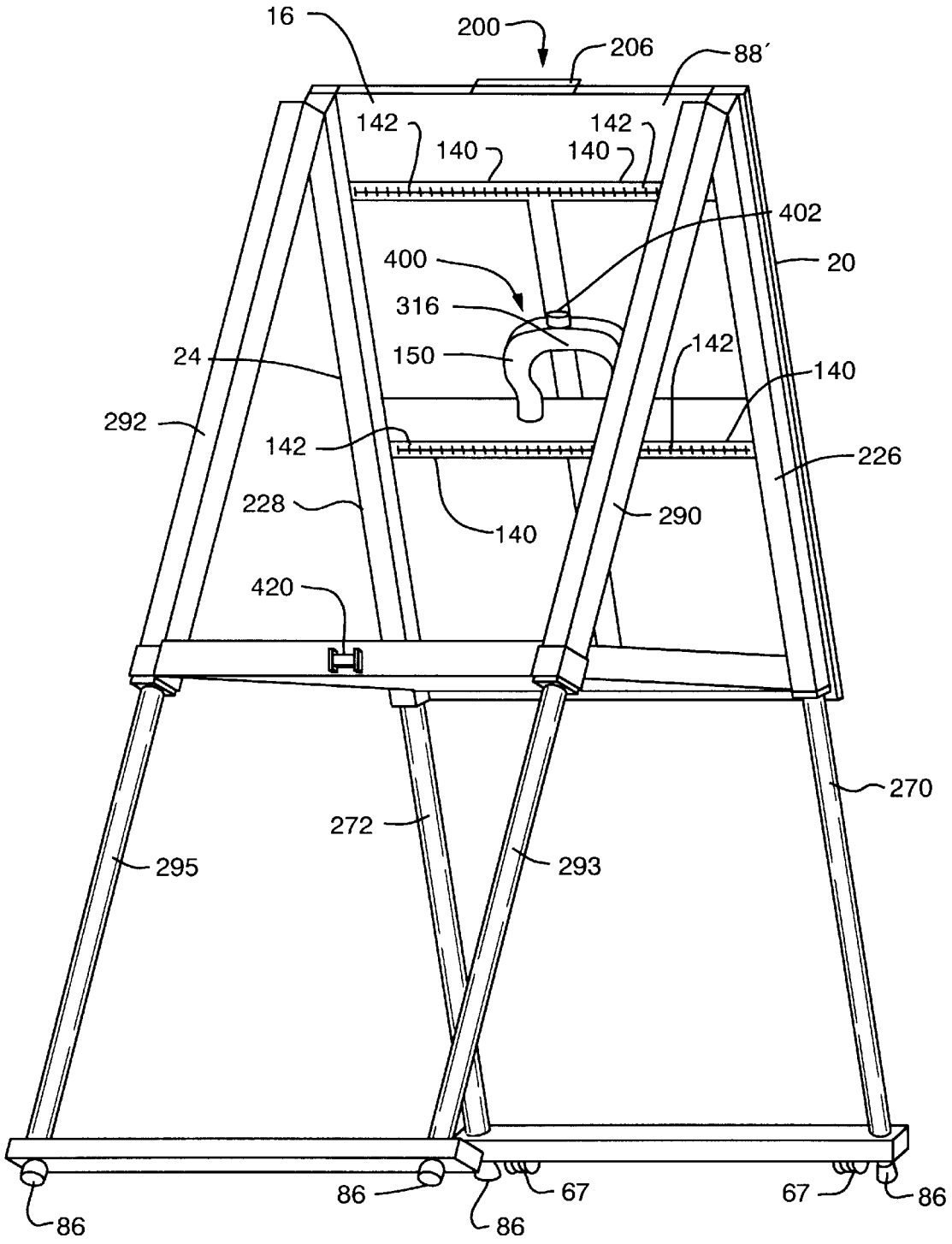
FIG. 21 is a rear perspective view of the presentation easel of FIG. 13.
Figure 22:
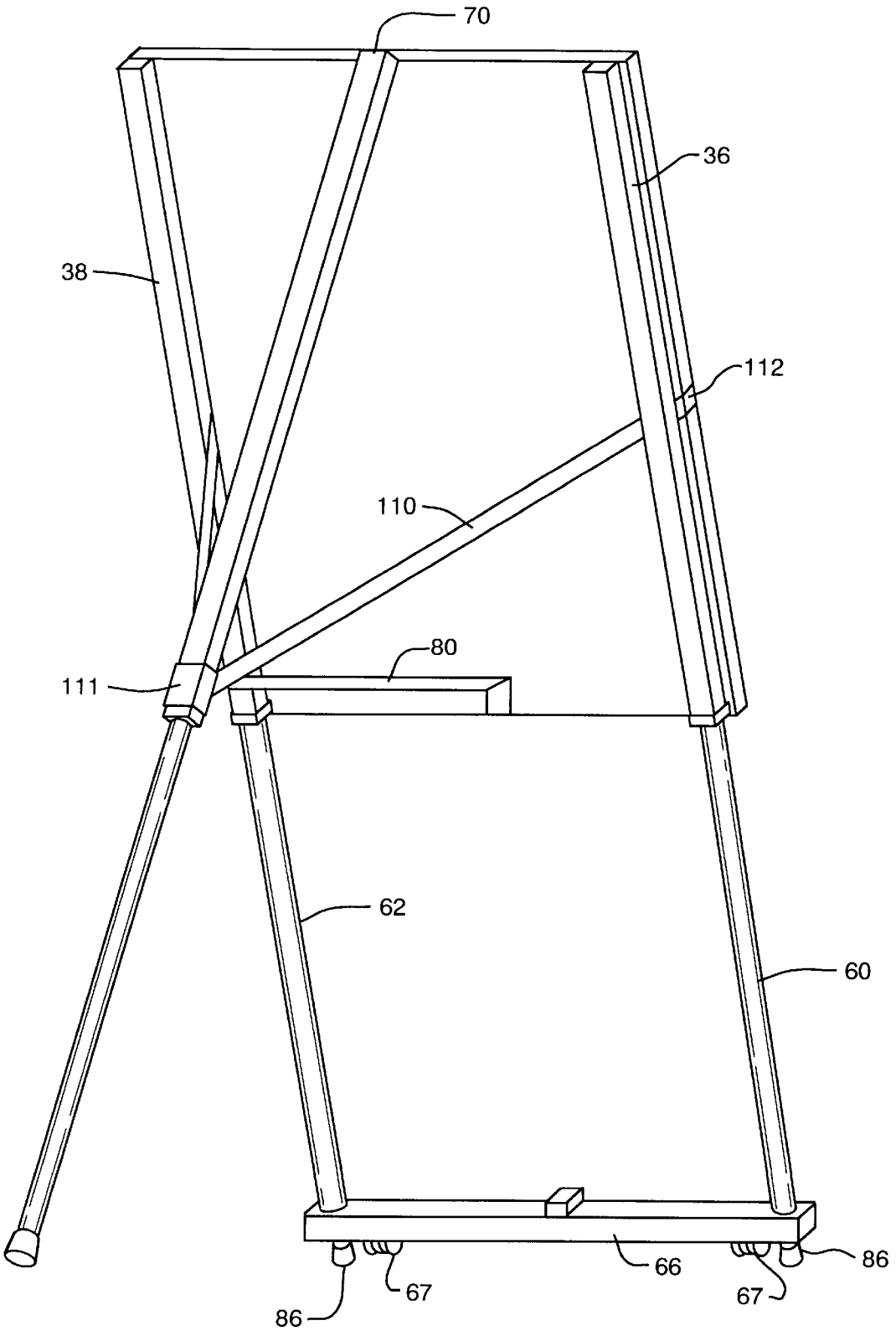
FIG. 22 is a rear perspective view of the presentation easel of FIG. 1.

FIG. 20B illustrates an exploded view of a portion of spring loaded pin assembly 431 or 433. A cover 480 is conveniently provided for levers 422, 424. FIG. 21 is a rear perspective view showing the second embodiment 200 of the presentation easel of the present invention and FIG. 22 is a rear perspective view of the first embodiment 10 in which a tripod structure is presented.

In accordance with the present invention, first attachment 130, first accessory 170, and second accessory 190 are all suitable for use with presentation easel 200. Preferably a rear surface 88' of fabric shell 206 is similar to or identical to rear surface 88 illustrated in FIG. 3 in that a plurality of compartments 140 are provided for storage and the like. FIG. 21 generally illustrates this embodiment.

While preferred embodiments have been shown and described, various modifications and substitutions may be made hereto without departing from the spirit and scope of the invention. Accordingly, it is to be understood that the present invention has been described by way of illustrations and not limitation.

What is claimed is:

1. A portable easel, comprising:

a frame including spaced first and second upper front leg members and a pair of horizontal connecting members connected to the first and second spaced upper front leg members, the upper front leg members being substantially parallel to one another;

a shell disposed around the frame so that a cavity is formed between the shell, the shell having a front support surface for holding an object and a first side containing a fastenable opening permitting access to the cavity;

first and second adjustable front legs, the first leg being adjustably received within the first upper front leg member and the second leg being adjustably received within the second upper front leg member;

a cross member horizontally extending between the first and second adjustable front legs;

a pair of wheels attached to the cross member; and at least one adjustable rear leg assembly connected to the frame to support the frame in an upright position.

2. A portable easel, comprising:

a frame including spaced first and second upper front leg members and a pair of horizontal connecting members connected to the first and second spaced upper front leg members, the upper front leg members being substantially parallel to one another;

a shell disposed around the frame so that a cavity is formed between the shell, the shell having a front support surface for holding an object and a first side containing a fastenable opening permitting access to the cavity, wherein the shell has a rectangular shape defined by the frame and is formed of a fabric;

first and second adjustable front legs, the first leg being adjustably received within the first upper front leg member and the second leg being adjustably received within the second upper front leg member; and at least one adjustable rear leg assembly connected to the frame to support the frame in an upright position.

3. The portable easel as set forth in claim 1, wherein the frame is generally rectangular and the first and second upper front leg members and a pair of horizontal connecting members each comprise rectangular tubular members.

4. The portable easel set forth in claim 3, and further including an attachment arranged to cover said front support surface of said shell, said attachment having an indicia display surface, and means for temporarily securing said attachment over the front support surface.

5. The portable easel set forth in claim 4, wherein said attachment comprises a detachable fabric piece having a selectable customized logo on said indicia display surface.

6. The portable easel set forth in claim 4, wherein said means for temporarily securing the attachment comprises mating zippers on the peripheries of said shell and said attachment.

7. The portable easel as set forth in claim 2, wherein the fastenable first side of the shell includes has a zippered opening to permit access to the cavity formed within the shell.

8. The portable easel as set forth in claim 2, wherein the at least one rear leg assembly comprises first and second upper rear leg members and first and second adjustable rear legs, the first rear leg being adjustably received within the first upper rear leg member and the second rear leg being adjustable received within the second upper rear leg member.

9. The portable easel as set forth in claim 8, wherein each of the first and second adjustable front legs are secured at a predetermined location in the first and second upper front leg members by a retractable pin assembly which engages a first side bore to lock the front legs in a retracted position and engages a second side bore to lock the front legs in an extended position.

10. The portable easel as set forth in claim 2, wherein the shell includes a rear surface having a plurality of storage compartments formed therein, wherein each of the plurality of storage compartments comprises a fabric pouch secured to the shell and including a fastenable opening.

11. A portable easel, comprising:

a frame including spaced first and second upper front leg members and a pair of horizontal connecting members connected to the first and second spaced upper front leg members, the upper front leg members being substantially parallel to one another;

a shell disposed around the frame so that a cavity is formed between the shell, the shell having a front support surface for holding an object and a first side containing a fastenable opening permitting access to the cavity;

first and second adjustable front legs, the first leg being adjustably received within the first upper front leg member and the second leg being adjustably received within the second in upper front leg member;

first and second upper rear leg members adjustably connected to the first and second upper front leg members at upper ends of the first and second upper front leg members; and first and second adjustable rear legs, the first rear leg being adjustable within the first upper leg member between a retracted position and an extended position, the second rear leg being adjustable within the second upper leg member between a retracted position and an extended position.

12. The portable easel as set forth in claim 11, further including a shelf adjustably secured to lower ends of the first and second upper front leg members and lower ends of the first and second upper rear leg members, the shelf being adjustable between an up position and a down position.

13. The portable easel as set forth in claim 12, wherein the shelf includes a pair of sliders secured to the shelf, each of the sliders having a central opening which receives one of the first and second upper rear leg members so that as the sliders slidingly travel along the first and second upper rear leg members, the shelf adjusts between the up position and the down position.

14. The portable easel as set forth in claim 13, wherein the shelf includes a second push button assembly for locking one end of the shelf to the first and second upper rear leg members and the first and second adjustable rear legs.

15. The portable easel as set forth in claim 14, wherein the second push button assembly includes a first spring loaded pin mechanism with a first moveable bar being connected to a first spring loaded retractable pin and a second spring loaded pin mechanism with a second moveable bar being connected to a second spring loaded retractable pin, the first spring loaded pin locking the first upper rear leg member and the first adjustable rear leg to one another, the second spring loaded pin locking the second upper rear leg member and the second adjustable leg to one another.

16. The portable easel as set forth in claim 15, wherein the first and second spring loaded pins each extend through a bore formed in one of the sliders to engage the first and second upper rear leg members and the first and second adjustable legs.

17. The portable easel as set forth in claim 11, wherein the shell is formed of a fabric and includes a rear surface opposite the front support surface, the rear surface having a plurality of fabric storage compartments formed therein.

18. The portable easel as set forth in claim 17, wherein the rear surface further includes a handle secured thereto, the handle including a first push button assembly for locking and releasing the first and second adjustable front legs within the first and second upper front leg members, wherein the first push button assembly includes first and second retractable pins, the first retractable pin locking the first adjustable front leg to the first upper front leg support by extending through a first bore formed in the first upper front leg support and protruding at least partially through an axially aligned second bore formed in the first adjustable front leg, the second retractable pin locking the second adjustable front leg to the second upper front leg support by extending through a third bore formed in the second upper front leg support and protruding at least partially through an axially aligned fourth bore formed in the second adjustable front leg.

19. The portable easel as set forth in claim 11, wherein each of the upper ends of the first and second upper rear leg members are adjustably connected to upper ends of the first and second upper front leg members by a hinge.

20. The portable easel as set forth in claim 11, further including:

a first cross member horizontally extending between the first and second adjustable front legs and a second cross member horizontally extending between the first and second adjustable rear legs, the first cross member including a pair of wheels.

21. The portable easel as set forth in claim 11, wherein the frame is generally rectangular with the first and second upper front leg members being generally perpendicular to the pair of horizontal connecting members, wherein each of first and second upper front leg members and the pair of horizontal connecting members comprises a rectangular tubular member.

22. The portable easel as set forth in claim 11, wherein the shell is formed of a fabric and is disposed around the first and second upper front leg members and the pair of horizontal connecting members so that a tightly fitted shell body is formed including a front surface for supporting a display item.

* * * * *